US010450534B2

(12) United States Patent
Hunt, Jr. et al.

(10) Patent No.: US 10,450,534 B2
(45) Date of Patent: Oct. 22, 2019

(54) METHODS AND CLEANING SOLUTIONS FOR REMOVING CHEWING GUM AND OTHER STICKY FOOD SUBSTANCES

(71) Applicant: ECOLAB USA INC., Saint Paul, MN (US)

(72) Inventors: Clinton Hunt, Jr., Saint Paul, MN (US); Tanya Paola Tristan Garza, Neuvo León (MX); Mallory Jo Tevis, Saint Paul, MN (US); Mark Andrew Malwitz, Saint Paul, MN (US); Marne Colleen Rasinen, Saint Paul, MN (US); Eric Joseph Ditzel, Saint Paul, MN (US); Scott Lyman Burnett, Saint Paul, MN (US); Sara Trevino Garza, Saint Paul, MN (US)

(73) Assignee: Ecolab USA Inc., Saint Paul, MN (US)

( * ) Notice: Subject to any disclaimer, the term of this patent is extended or adjusted under 35 U.S.C. 154(b) by 103 days.

(21) Appl. No.: 15/654,176

(22) Filed: Jul. 19, 2017

(65) Prior Publication Data

US 2018/0023038 A1 Jan. 25, 2018

Related U.S. Application Data

(60) Provisional application No. 62/364,043, filed on Jul. 19, 2016.

(51) Int. Cl.

| | |
|---|---|
| ***C11D 3/43*** | (2006.01) |
| ***C11D 3/20*** | (2006.01) |
| ***C11D 7/50*** | (2006.01) |
| ***C11D 7/26*** | (2006.01) |
| ***C11D 11/00*** | (2006.01) |

(52) U.S. Cl.

CPC ..... *C11D 3/2065* (2013.01); *C11D 3/2093* (2013.01); *C11D 7/261* (2013.01); *C11D 7/266* (2013.01); *C11D 7/50* (2013.01); *C11D 11/0023* (2013.01); *C11D 11/0052* (2013.01); *B08B 2220/02* (2013.01)

(58) Field of Classification Search

CPC ..... C11D 1/667

See application file for complete search history.

(56) References Cited

U.S. PATENT DOCUMENTS

| | | | |
|---|---|---|---|
| 4,274,884 | A | 6/1981 | Cartwright |
| 4,306,989 | A | 12/1981 | Motsenbocker |
| 5,688,334 | A | 11/1997 | Gaul |
| 5,750,579 | A | 5/1998 | Kamishita et al. |
| 5,820,696 | A | 10/1998 | Kimura et al. |
| 5,856,291 | A | 1/1999 | Thomas et al. |
| 5,874,393 | A | 2/1999 | Drapier et al. |
| 5,906,973 | A | 5/1999 | Ouzounis et al. |
| 6,121,220 | A | 9/2000 | Sandhu et al. |
| 6,265,367 | B1 | 7/2001 | Callaghan et al. |
| 6,310,022 | B1 | 10/2001 | Amiran |
| 6,613,158 | B2 | 9/2003 | Gross |
| 6,670,314 | B2 | 12/2003 | Smith et al. |
| 6,673,767 | B1 | 1/2004 | Brodbeck et al. |
| 6,683,036 | B2 | 1/2004 | Foley et al. |
| 6,696,044 | B2 | 2/2004 | Luo et al. |
| 6,821,937 | B2 | 11/2004 | Gross |
| 7,390,518 | B2 | 6/2008 | Gebreselassie et al. |
| 7,629,305 | B1 | 12/2009 | Szekeres et al. |
| 7,637,271 | B1 | 12/2009 | Cumberland et al. |
| 7,759,298 | B2 | 7/2010 | Dufresne et al. |
| 7,951,768 | B2 | 5/2011 | Boutique et al. |
| 8,167,990 | B2 | 5/2012 | De Saint-Romain |
| 8,173,588 | B2 | 5/2012 | Ina et al. |
| 8,211,481 | B2 | 7/2012 | Mosconi |
| 8,563,232 | B2 | 10/2013 | Wolfinbarger, Jr. et al. |
| 8,574,609 | B2 | 11/2013 | Lopes |
| 8,778,093 | B2 | 7/2014 | Crawford et al. |
| 8,809,250 | B2 | 8/2014 | Parrish et al. |
| 8,854,714 | B2 | 10/2014 | Clapp et al. |
| 9,139,798 | B2 | 9/2015 | Holzhauer et al. |
| 9,296,909 | B2 | 3/2016 | Zhou et al. |
| 9,309,485 | B2 | 4/2016 | Hunt et al. |
| 2003/0119689 | A1 | 6/2003 | Hutton et al. |
| 2004/0038847 | A1 | 2/2004 | Gross |
| 2005/0032670 | A1 | 2/2005 | Besseling |
| 2005/0106214 | A1 | 5/2005 | Chen |
| 2005/0119143 | A1 | 6/2005 | Egbe et al. |
| 2005/0233925 | A1 | 10/2005 | Foley et al. |
| 2006/0088596 | A1 | 4/2006 | Labrecque et al. |
| 2006/0180795 | A1* | 8/2006 | McCormick ..... C11D 3/0073 252/387 |
| 2006/0255315 | A1 | 11/2006 | Yellowaga et al. |
| 2007/0037717 | A1 | 2/2007 | Clark et al. |
| 2007/0179073 | A1 | 8/2007 | Smith et al. |
| 2009/0118658 | A1 | 5/2009 | Tarinelli et al. |
| 2009/0206296 | A1 | 8/2009 | Bakul |
| 2010/0003310 | A1 | 1/2010 | Holme et al. |
| 2010/0056413 | A1 | 3/2010 | Harry, Jr. et al. |

(Continued)

FOREIGN PATENT DOCUMENTS

| | | | |
|---|---|---|---|
| AT | 409968 | * | 5/2002 |
| AT | 409968 B | | 12/2002 |

(Continued)

OTHER PUBLICATIONS

European Patent Office, "Notification of Transmittal of the International Search Report and the Written Opinion of the International Searching Authority, or the Declaration" issued in connection to International Application No. PCT/US2017/042826, dated Oct. 6, 2017.

(Continued)

*Primary Examiner* — Charles I Boyer

(74) *Attorney, Agent, or Firm* — McKee, Voorhees & Sease, PLC

(57) ABSTRACT

Cleaning compositions and methods for removing chewing gum, its components and other sticky soils from surfaces, especially production facilities, are disclosed. Cleaning composition solutions that do not require a rinse step are disclosed and suitable for treatment of surfaces having indirect food contact. In an aspect, the cleaning compositions and methods employ a scraping-spraying-wiping procedure.

17 Claims, 14 Drawing Sheets

(56) References Cited

U.S. PATENT DOCUMENTS

| | | | | |
|---|---|---|---|---|
| 2010/0081602 | A1* | 4/2010 | Deak | B01D 17/0202 510/299 |
| 2010/0234271 | A1 | 9/2010 | Scheuing et al. | |
| 2012/0289446 | A1 | 11/2012 | Crawford et al. | |
| 2013/0053298 | A1* | 2/2013 | Holzhauer | C11D 1/83 510/505 |
| 2013/0336905 | A1 | 12/2013 | Fares et al. | |
| 2014/0144473 | A1 | 5/2014 | Martin | |
| 2014/0179584 | A1 | 6/2014 | Catlin et al. | |
| 2014/0349905 | A1 | 11/2014 | Benda et al. | |
| 2014/0352740 | A1 | 12/2014 | Hunt, Jr. et al. | |
| 2015/0126624 | A1 | 5/2015 | Baseeth | |
| 2016/0008295 | A1 | 1/2016 | Tseng et al. | |

FOREIGN PATENT DOCUMENTS

| | | | |
|---|---|---|---|
| GB | 1605154 | A | 5/1982 |
| WO | 9208836 | A1 | 5/1992 |
| WO | 9600622 | A1 | 1/1996 |
| WO | 2015006362 | A1 | 1/2015 |
| WO | 2015017659 | A1 | 2/2015 |
| WO | 2015055234 | A1 | 4/2015 |
| WO | 2015078496 | A1 | 6/2015 |
| WO | 2015123734 | A1 | 8/2015 |

OTHER PUBLICATIONS

Burke, "Solubility Parameters: Theory and Application", URL: http://cool.conservation-us.org/coolaic/sg/bpg/annual/v03/bp03-04.html, 1984.

Pereira, et al., "Ethyl lactate as a solvent: Properties, applications and production processes—a review", Green Chemistry, vol. 13, pp. 2658-2671, 2011.

* cited by examiner

METHODS AND CLEANING SOLUTIONS FOR REMOVING CHEWING GUM AND OTHER STICKY FOOD SUBSTANCES

CROSS REFERENCE TO RELATED APPLICATION

This application claims priority and is related to U.S. Provisional Application Ser. No. 62/364,043 filed on Jul. 19, 2016. The entire contents of this patent application are hereby expressly incorporated herein by reference including, without limitation, the specification, claims, and abstract, as well as any figures, tables, or drawings thereof.

FIELD OF THE INVENTION

The disclosure relates to cleaning compositions and methods for removing chewing gum, its components and other sticky soils from surfaces, especially production facilities. In particular, the disclosure provides cleaning composition solutions that do not require a rinse step and are particularly suitable for treatment of surfaces for indirect food contact operations. In a particular aspect, the cleaning compositions and methods may employ a scraping-spraying-wiping procedure.

BACKGROUND OF THE INVENTION

Solvents derived from renewable biological feedstocks that are non-toxic and have very good environmental properties are becoming highly desirable for replacement of many halogenated or other toxic solvents. D-limonene is a biodegradable cleaning solvent and degreaser occurring in nature as the main component of citrus peel oil. These user-friendly characteristics encourage the use of d-limonene in solvent applications. However, d-limonene lacks some physical properties that limit its applicability to more widespread use.

D-limonene is not water-miscible and consequently not easily water-rinsable and is considered a non-aqueous cleaning solvent. D-limonene is a slow-drying solvent that does not quickly evaporate from surfaces to which it has been applied.

In many cleaning applications, water miscibility is important. Being able to rinse a solvent-cleaned surface with water after the solvent cleaning step is preferable to rinsing with an organic solvent. Furthermore, aqueous rinses are often easier to handle and dispose of after application. Thus, water rinse ability is highly desirable in a cleaning solvent for economic and environmental reasons.

It is an object of the present disclosure to provide cleaning compositions that include environmentally desirable solvent components and which also provide superior cleaning of surfaces as a replacement for d-limonene or other solvents with limitations enumerated herein.

It is a further object of the present disclosure to provide cleaning compositions that are food-safe such that no rinse step is required.

BRIEF SUMMARY OF THE INVENTION

An advantage of the disclosure is a cleaning composition that effectively removes chewing gum, its components and other sticky soils from surfaces. The present disclosure solves problems in the art by providing a composition that more effectively removes chewing gum, its components and other sticky soils from surfaces.

Moreover, particular embodiments can be free of any or all of the following: D-limonene, phosphorous, NPEs, petroleum distillates, and other components which are not suitable for indirect food contact, which have been required for effective cleaning in conventional chewing gum and/or other adhesive remover compositions known in the art.

The advantages of the disclosed composition without D-limonene which is currently used to remove chewing gum, its components, and other sticky soils from surfaces, are lack of D-limonene odor, faster drying of the treated surface (removal of the composition itself) and easier to be rinsed off if necessary. D-limonene has an odor threshold of 200 ppb (part per billion), while the ingredients in the disclosed composition have a much higher odor threshold. For example, ethyl lactate has an odor threshold of 14000 ppb. As the result of not using D-limonene, the disclosed composition can be easily formulated to have a more pleasant odor, with a reduced amount of the chemicals for having the desired odor and no need to suppress the odor of D-limonene.

The present disclosure can be tailored to reduce and/or eliminate water in the cleaning composition solutions while effectively removing chewing gum, its components and other sticky soils from surfaces in comparison to existing cleaning compositions and methods.

The present disclosure is particularly suitable for spray applications that do not require soaking, including a scraping-spraying-wiping procedure. Moreover, the spray applications do not require a rinse step due to the inclusion of cleaning composition components suitable for indirect food contact, which may include cleaning composition components having a GRAS rating.

In one aspect, disclosed herein is a cleaning composition for application on a chewing gum residue or other sticky substance, the composition comprises about 1 wt-% to about 50 wt-% of a diluent; about 5 wt-% to about 40 wt-% of a polyol; and about 10 wt-% to about 50 wt-% of an alkyl ester.

In some embodiments in the disclosed composition, the ratio of the polyol to alkyl ester is from about 10:1 to about 1:10.

In some embodiments, the polyol in the composition is propylene glycol, glycerin, or a combination thereof. In other embodiments, the alkyl ester is ethyl lactate, polysorbate, or a combination thereof.

In some embodiments, the disclosed compositions are free of d-limonene. In some other embodiments, the disclosed compositions are free of any material that is not considered to be GRAS or food additive ingredient.

In some embodiments, the disclosed compositions comprise about 1 wt-% to about 40 wt-% of diluent, about 5 wt-% to about 30 wt-% of the polyol, and about 10 wt-% to about 40 wt-% of the alkyl ester. In some other embodiments, the compositions comprise 1 wt-% to about 50 wt-% of water, about 10 wt-% to about 20 wt-% of the propylene glycol, and about 15 wt-% to about 30 wt-% of polysorbate 80.

In some embodiments, the disclosed compositions further comprise one additional functional ingredient. In some other embodiments, the additional ingredient is a dye, a fragrance, a buffer, or a combination thereof.

In yet some other embodiments, the disclosed compositions further comprise a buffer. In some other embodiments, the buffer is from an organic acid, salt thereof, or mixture thereof. In yet some embodiments, the buffer is from sodium of acetate.

In some embodiments, in the disclosed compositions, the diluent is water. In some other embodiments, the diluent is a simple or mono alcohol. In yet some other embodiments, the diluent is water, simple alcohol, or a combination thereof.

In some embodiments, in the disclosed compositions, the polyol is propylene glycol. In some other embodiments, the polyol is glycerine. In yet some other embodiments, the polyol is propylene glycol, glycerine, or a combination thereof.

In some embodiments, in the disclosed compositions, the ester is ethylene acetate. In some other embodiments, the ester is polysorbate 80. In yet some other embodiments, the ester is ethylene acetate, polysorbate, or a combination thereof.

In other aspect, the disclosed herein is a method of removing chewing gum residue and/or other sticky food substances. The disclosed method comprises optionally scraping a surface to remove excess chewing gum or other sticky food substance; and contacting the surface with a use solution of the cleaning composition or the cleaning composition disclosed herein; and optionally removing the chewing gum or other sticky food substance from the surface, wherein the surface has some soil left by chewing gum or other sticky food substances.

In some embodiments of the disclosed methods, the contacting the surface with the disclosed cleaning composition is spraying the cleaning composition on to the surface to be cleaned.

In some embodiments of the disclosed methods, the pH of the use solution or the cleaning composition is between about 3 and about 12. In some other embodiments, the use solution or the cleaning composition is at a temperature between about 70° F. and about 100° F.

In some embodiments of the disclosed methods, the contacting the soiled surface with the cleaning composition is for a period of time to remove the soil, wherein the period of time is from 1 second to 30 minutes. In some other embodiments, the period of time is from about 30 seconds to about 5 minutes. In yet some other embodiments, the period of time is from about 60 seconds to about 10 minutes. In some embodiments, the period of time is from about 2 minutes to about 5 minutes.

In some embodiments, the disclosed method does not include a rinse step. In some other embodiments, the removing step is wiping the surface.

In some embodiments, for the disclosed methods, the surface is a food processing or production surface. In some other embodiments, the surface is a hard surface. In yet some other embodiments, the surface is one of stainless steel, plastics, polyethylene, polypropylene, aluminum, marble, granite, rubber, and concrete.

In light of these advantages, the present disclosure can be more labor, energy, and cost efficient in comparison to existing cleaning compositions and methods. Other objects, advantages and features of the present disclosure will become apparent from the following specification taken in conjunction with the accompanying drawings.

While multiple embodiments are disclosed, still other embodiments of the present disclosure will become apparent to those skilled in the art from the following detailed description, which shows and describes illustrative embodiments of the disclosure. Accordingly, the drawings and detailed description are to be regarded as illustrative in nature and not restrictive.

BRIEF DESCRIPTION OF THE DRAWINGS

FIG. 1A shows the coupons with gum before scraping, FIG. 1B shows the coupons after scraping and still containing gum residue, and FIG. 1C shows the coupons after spray of eight experimental formulas and two controls and wiping.

FIG. 2A shows the gum on the coupons before melting, FIG. 2B shows the coupons with gum before scraping, FIG. 2C shows the coupons after scraping and still containing gum residue, and FIG. 2D shows the coupons after spray of the experimental formula/controls and wiping.

FIG. 3A shows the gum on the coupons before melting, FIG. 3B shows the coupons with gum before scraping, FIG. 3C shows the coupons after scraping and still containing gum residue, and FIG. 3D shows the coupons after spray of the experimental formula/controls and wiping.

FIG. 4A shows the gum on the coupons before melting, FIG. 4B shows the coupons with gum before scraping, FIG. 4C shows the coupons after scraping and still containing gum residue, and FIG. 4D shows the coupons after spray of the experimental formula/controls and wiping.

FIG. 5A shows the gum on the coupons before melting, FIG. 5B shows the coupons with gum before scraping, FIG. 5C shows the coupons after scraping and still containing gum residue, and FIG. 5D shows the coupons after spray of the experimental formula/controls and wiping.

FIG. 6A shows the gum on the coupons before melting, FIG. 6B shows the coupons with gum before scraping, FIG. 6C shows the coupons after scraping and still containing gum residue, and FIG. 6D shows the coupons after spray of the experimental formula/controls and wiping.

FIG. 7A shows the coupons with five flavored gums before scraping. FIG. 7B shows the coupons after scraping and still containing gum residue. FIG. 7C shows the coupons with some residue remaining after spray of the experimental formula and wiping.

FIG. 8A shows the gum on the coupons before scraping, FIG. 8B shows the coupons with gum after scraping, and FIG. 8C shows the coupons after spray of the experimental formula/controls and wiping.

FIG. 9A shows the gum on the coupons before scraping, FIG. 9B shows the coupons with gum after scraping, and FIG. 9C shows the coupons after wiping.

Figure 1A:
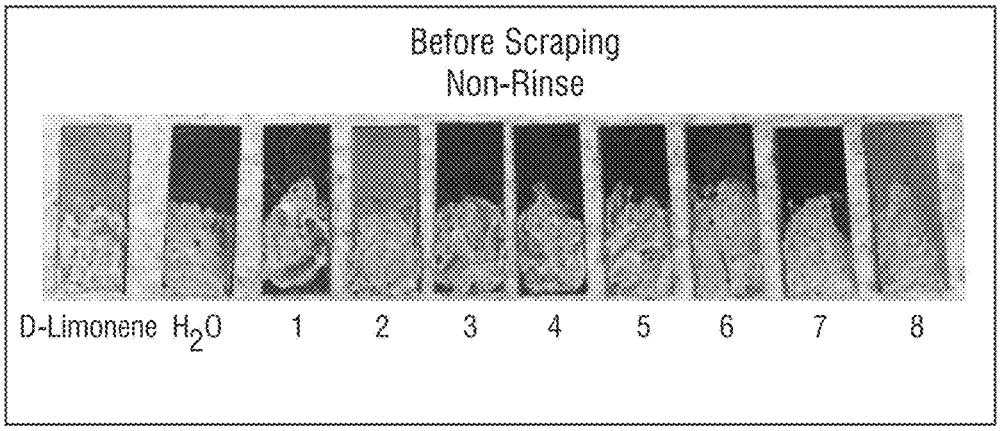
FIGS. 1A-C show phases of evaluation of a "non-rinse" gum removal experiment featuring a single spray and wipe step, with no soaking.

Various embodiments of the present disclosure will be described in detail with reference to the drawings, wherein like reference numerals represent like parts throughout the several views. Reference to various embodiments does not limit the scope of the disclosure. Figures represented herein are not limitations to the various embodiments according to the disclosure and are presented for exemplary illustration of the disclosure.

DETAILED DESCRIPTION OF THE PREFERRED EMBODIMENT

The embodiments of this disclosure are not limited to particular cleaning compositions and methods for removing chewing gum, its components and other sticky soils from surfaces, which can vary and are understood by skilled artisans. It is further to be understood that all terminology used herein is for the purpose of describing particular embodiments only, and is not intended to be limiting in any manner or scope. For example, as used in this specification and the appended claims, the singular forms "a," "an" and "the" can include plural referents unless the content clearly indicates otherwise. Further, all units, prefixes, and symbols may be denoted in its SI accepted form.

Numeric ranges recited within the specification are inclusive of the numbers within the defined range. Throughout this disclosure, various aspects of this disclosure are presented in a range format. It should be understood that the description in range format is merely for convenience and brevity and should not be construed as an inflexible limitation on the scope of the disclosure. Accordingly, the description of a range should be considered to have specifically disclosed all the possible sub-ranges as well as individual numerical values within that range (e.g. 1 to 5 includes 1, 1.5, 2, 2.75, 3, 3.80, 4, and 5).

So that the present disclosure may be more readily understood, certain terms are first defined. Unless defined otherwise, all technical and scientific terms used herein have the same meaning as commonly understood by one of ordinary skill in the art to which embodiments of the disclosure pertain. Many methods and materials similar, modified, or equivalent to those described herein can be used in the practice of the embodiments of the present disclosure without undue experimentation. The preferred materials and methods are described herein. In describing and claiming the embodiments of the present disclosure, the following terminology will be used in accordance with the definitions set out below.

The term "about," as used herein, refers to variation in the numerical quantity that can occur, for example, through typical measuring and liquid handling procedures used for making concentrates or use solutions in the real world; through inadvertent error in these procedures; through differences in the manufacture, source, or purity of the ingredients used to make the compositions or carry out the methods; and the like. The term "about" also encompasses amounts that differ due to different equilibrium conditions for a composition resulting from a particular initial mixture. Whether or not modified by the term "about", the claims include equivalents to the quantities.

The term "actives" or "percent actives" or "percent by weight actives" or "actives concentration" are used interchangeably herein and refers to the concentration of those ingredients involved in cleaning expressed as a percentage minus inert ingredients such as water or salts.

As used herein, the term "substantially free", "substantially free of", or "free of" refers to compositions completely lacking the component or having such a small amount of the component that the component does not affect the performance of the composition. The component may be present as an impurity or as a contaminant and shall be less than 0.5 wt-%. In another embodiment, the amount of the component is less than 0.1 wt-% and in yet another embodiment, the amount of component is less than 0.01 wt-%.

The term "alkyl" as used herein includes both "unsubstituted alkyls" and "substituted alkyls." As used herein, the term "substituted alkyls" refers to alkyl groups having substituents replacing one or more hydrogens on one or more carbons of the hydrocarbon backbone. Such substituents may include, for example, alkenyl, alkynyl, halogeno, hydroxyl, alkylcarbonyloxy, arylcarbonyloxy, alkoxycarbonyloxy, aryloxy, aryloxycarbonyloxy, carboxylate, alkylcarbonyl, arylcarbonyl, alkoxycarbonyl, aminocarbonyl, alkylaminocarbonyl, dialkylaminocarbonyl, alkylthiocarbonyl, alkoxyl, phosphate, phosphonato, phosphinato, cyano, amino (including alkyl amino, dialkylamino, acylamino, diarylamino, and alkylarylamino), acylamino (including alkylcarbonylamino, arylcarbonylamino, carbamoyl and ureido), imino, sulfhydryl, alkylthio, arylthio, thiocarboxylate, sulfates, alkylsulfinyl, sulfonates, sulfamoyl, sulfonamido, nitro, trifluoromethyl, cyano, azido, heterocyclic, alkylaryl, or aromatic (including hetero aromatic) groups.

As used herein, the term "cleaning" refers to a method used to facilitate or aid in soil removal, including chewing gum and other sticky food substances), microbial population reduction, and any combination thereof. As used herein, the term "microorganism" refers to any noncellular or unicellular (including colonial) organism. Microorganisms include all prokaryotes. Microorganisms include bacteria (including cyanobacteria), spores, lichens, fungi, protozoa, virinos, viroids, viruses, phages, and some algae. As used herein, the term "microbe" is synonymous with microorganism.

As used herein, the phrase "food processing surface" refers to a surface of a tool, a machine, equipment, a structure, a building, or the like that is employed as part of a food processing, preparation, or storage activity. Examples of food processing surfaces include surfaces of food processing or preparation equipment (e.g., slicing, canning, or transport equipment, including flumes), of food processing wares (e.g., utensils, dishware, wash ware, and bar glasses), and of floors, walls, or fixtures of structures in which food processing occurs. Food processing surfaces are found and employed in food anti-spoilage air circulation systems, aseptic packaging sanitizing, food refrigeration and cooler cleaners and sanitizers, ware washing sanitizing, blancher cleaning and sanitizing, food packaging materials, cutting board additives, third-sink sanitizing, beverage chillers and warmers, meat chilling or scalding waters, autodish sanitizers, sanitizing gels, cooling towers, food processing antimicrobial garment sprays, and non-to-low-aqueous food preparation lubricants, oils, and rinse additives.

A surface can be made from, for example, stainless steel, plastics, polyethylene, polypropylene, aluminum, marble, granite, rubber, concrete, or a combination thereof.

As used herein, the phrase "food product" includes any food substance that might require treatment with an antimicrobial agent or composition and that is edible with or without further preparation. Food products include meat (e.g. red meat and pork), seafood, poultry, produce (e.g., fruits and vegetables), eggs, living eggs, egg products, ready to eat food, wheat, seeds, roots, tubers, leafs, stems, corns, flowers, sprouts, seasonings, or a combination thereof. The term "produce" refers to food products such as fruits and vegetables and plants or plant-derived materials that are typically sold uncooked and, often, unpackaged, and that can sometimes be eaten raw.

The term "generally recognized as safe" or "GRAS," as used herein refers to components classified by the Food and Drug Administration as safe for direct human food consumption or as an ingredient based upon current good manufacturing practice conditions of use, as defined for example in 21 C.F.R. Chapter 1, § 170.38 and/or 570.38. Under 21 CFR 170.30(b), general recognition of safety through scientific procedures requires the same quantity and quality of scientific evidence as is required to obtain approval of the substance as a food additive and ordinarily is based upon published studies, which may be corroborated by unpublished studies and other data and information. U.S. EPA exemptions for active and inert ingredients in contact with food are codified at 40 C.F.R. Chapter 180 and requires that the amounts indicated are safe for human consumption.

The term "hard surface" refers to a solid, substantially non-flexible surface such as a counter top, tile, floor, wall, panel, window, plumbing fixture, kitchen and bathroom furniture, appliance, engine, circuit board, and dish. Hard surfaces may include for example, health care surfaces and food processing surfaces.

As used herein, the phrasess "limonene-free," "D-limonene," "substantially D-limonene-free," "substantially limonene-free," or any variations of the same, refer to a composition, mixture, or ingredient that does not contain any limonene or a limonene-containing compound has not been added. Should limonene or a limonene-containing compound be present through contamination of a limonene-free composition, mixture, or ingredient, the amount of limonene shall be less than 0.5 wt %. More preferably, the amount of limonene is less than 0.1 wt-%, and most preferably the amount of limonene is less than 0.01 wt %.

As used herein, the phrase "meat product" refers to all forms of animal flesh, including the carcass, muscle, fat, organs, skin, bones and body fluids and like components that form the animal. Animal flesh includes, but is not limited to, the flesh of mammals, birds, fishes, reptiles, amphibians, snails, clams, crustaceans, other edible species such as lobster, crab, etc., or other forms of seafood. The forms of animal flesh include, for example, the whole or part of animal flesh, alone or in combination with other ingredients. Typical forms include, for example, processed meats such as cured meats, sectioned and formed products, minced products, finely chopped products, ground meat and products including ground meat, whole products, and the like.

As used herein, the phrase "medical adhesive" refers to any adhesive substance used to secure wound dressings, surgical drapes, bandages, sensors, such as EKG leads, and the like, including, bandages, tapes, skin sealant, and liquid sutures. They are often ethoxy-based or polyacrylic-based.

As used herein, the phrases "objectionable odor," "offensive odor," or "malodor," refer to a sharp, pungent, or acrid odor or atmospheric environment from which a typical person withdraws if they are able to. Hedonic tone provides a measure of the degree to which an odor is pleasant or unpleasant. An "objectionable odor," "offensive odor," or "malodor" has an hedonic tone rating it as unpleasant as or more unpleasant than a solution of 5 wt-% acetic acid, propionic acid, butyric acid, or mixtures thereof.

As used herein, the phrase "plant" or "plant product" includes any plant substance or plant-derived substance. Plant products include, but are not limited to, seeds, nuts, nut meats, cut flowers, plants or crops grown or stored in a greenhouse, house plants, and the like. Plant products include many animal feeds.

As used herein, the term "soil" or "stain" refers to a non-polar oily substance which may or may not contain particulate matter such as mineral clays, sand, natural mineral matter, carbon black, graphite, kaolin, environmental dust, etc.

The term "substantially similar cleaning performance" refers generally to achievement by a substitute cleaning product or substitute cleaning system of generally the same degree (or at least not a significantly lesser degree) of cleanliness or with generally the same expenditure (or at least not a significantly lesser expenditure) of effort, or both.

The term "weight percent," "wt-%," "percent by weight," "% by weight," and variations thereof, as used herein, refer to the concentration of a substance as the weight of that substance divided by the total weight of the composition and multiplied by 100. It is understood that, as used here, "percent," "%," and the like are intended to be synonymous with "weight percent," "wt-%," etc.

The methods and compositions of the present disclosure may comprise, consist essentially of, or consist of the components and ingredients of the present disclosure as well as other ingredients described herein. As used herein, "consisting essentially of" means that the methods and compositions may include additional steps, components or ingredients, but only if the additional steps, components or ingredients do not materially alter the basic and novel characteristics of the claimed methods and compositions.

Cleaning Compositions

The cleaning compositions according to the disclosure beneficially provide no-rinse food-safe compositions. The cleaning compositions are further beneficially low odor and impart minimal to no flavor to the treated food processing surface. These attributes are important because the cleaning composition residues can migrate into any food that contacts the treated surfaces. If the cleaning composition residues has any flavor or odor, the food may retain the flavor or odor when the food was consumed.

Exemplary compositions and ranges of the solvent-based cleaning composition solutions according to the disclosure are shown in Table 1 in weight percentage of the liquid cleaning compositions.

TABLE 1

| Material | First Exemplary Range wt-% | Second Exemplary Range wt-% | Third Exemplary Range wt-% | Fourth Exemplary Range wt-% |
|---|---|---|---|---|
| Water | 0-60 | 0-50 | 10-40 | 10-40 |
| Diluent | 5-70 | 10-50 | 15-50 | 20-50 |
| Polyol (e.g. propylene glycol or glycerine) | 5-40 | 5-35 | 5-30 | 10-20 |
| Alkyl esters (e.g. Ethyl lactate, Tween 80) | 10-50 | 10-40 | 15-40 | 15-30 |
| Additional Functional Ingredients | 0-40 | 0-20 | 0-10 | 0-5 |

In some respects, the ratio of the diluent to polyol to alkyl ester is from about 1:1:1 to about 2:1:2, or about 1:1:1:to about 1.75:1:1.75, including all ranges therein. In a preferred aspect, the ratio of the diluent to polyol to alkyl ester is from about 1:1:1 to about 1.5:1:1.75.

In some embodiments in the disclosed composition, the ratio of the polyol to alkyl ester is from about 10:1 to about 1:10. In some other embodiments, the ratio of the polyol to alkyl ester is from about 1.75:1 to about 1:1.75; from about 6:1 to about 1:2; or from about 3:1 to about 1:2. In some other embodiments, the ratio of the polyol to alkyl ester is from about 9:1 to about 1:9; from about 8:1 to about 1:8; from about 7:1 to about 1:7; from about 6:1 to about 1:6; from about 5:1 to about 1:5; from about 4:1 to about 1:4; from about 3:1 to about 1:3; from about 2:1 to about 1:2; from about 10:1 to about 1:7; from about 3:1 to 1:7; about 10:1; about 9:1; about 8:1; about 7:1, about 6:1, about 5:1, about 4:1, about 3:1, about 2:1, about 1:1, about 1:2; about 1:3; about 1:4; about 1:5; about 1:6; about 1:7; about 1:8; about 1:9; about 1:10, or any values between thereof.

The cleaning compositions according to the disclosure are aqueous compositions, preferably pumpable liquids having a viscosity between about 1-1000 cps, between about 20-250 cps, or between about 75-100 cps, including all ranges therein. The cleaning compositions may include concentrate compositions or may be diluted to form use compositions. In general, a concentrate refers to a composition that is intended to be diluted with water to provide a use solution that contacts an object to provide the desired cleaning. The cleaning composition that contacts the surfaces in need of chewing gum or other soil removal can be referred to as a concentrate or a use composition (or use solution) dependent upon the formulation employed in methods according to the disclosure.

In various aspects according to the disclosure, the cleaning composition does not require dilution prior to contacting the surface in need of cleaning.

In other aspects, a use solution may be prepared from a concentrate by diluting the concentrate with water at a dilution ratio that provides a use solution having desired cleaning properties. The water that is used to dilute the concentrate to form the use composition can be referred to as water of dilution, and can vary from one location to another. The typical dilution factor is between approximately 1 and approximately 1,000, or diluted at a ratio of between about 1:10 and about 1:1,000 concentrate to water. In an aspect of the disclosure, the cleaning composition preferably provides efficacious cleaning at low use dilutions, i.e., require less volume to clean effectively.

Diluent

The cleaning compositions according to the disclosure include a diluent. Suitable diluents include water and monoalcohols, such as benzyl alcohol. Low molecular weight primary or secondary alcohols exemplified by methanol, ethanol, propanol, and isopropanol are suitable. In some embodiments, water is preferred, while in other embodiments, one or more non-aqueous alcohols are preferred. In some other embodiments, the diluent can be a common solvent, organic solvent, or a combination thereof. Still other suitable diluents include the triglyceride 1,2,3-triacetoxypropane which is more generally known as triacetin and glycerin triacetate and which is the triester of glycerol and acetic acid. The diluent may be used in combination with other solvents, such as water.

In some preferred embodiments, the diluent of the cleaning composition is water. In some embodiments, the diluent can include water. In some other embodiments, the diluent can include softened water.

Without being limited to a particular mechanism of action or limitation with respect to the particular soil (e.g. chewing gum) to be removed, the amount of water or other diluent in the cleaning composition can vary, in part, depending upon the type of sticky soil to be removed. In a non-limiting embodiment of the disclosure, the amount of water or other diluent can be increased or decreased based upon the hydrophobicity of the sticky soil (e.g. chewing gum).

In a further aspect, the diluent is present in a use solution in an amount of from about 1 wt-% to about 60 wt-%, from about 5 wt-% to about 60 wt-%, 5 wt-% to about 50 wt-%, from about 10 wt-% to about 50 wt-%, from about 15 wt-% to about 50 wt-%, from about 1 wt-% to about 50 wt-%, or from about 20 wt-% to about 50 wt-%.

In cleaning compositions employing water as the diluent or part of the diluent, water is present in an amount from about 0 wt-% to about 60 wt-%, about 0 wt-% to about 50 wt-%, about 0 wt-% to about 40 wt-%, about 0 wt-% to about 30 wt-%, about 0 wt-% to about 20 wt-%, or about 0 wt-% to about 10 wt-%. In other aspects, water is present in an amount from about 1 wt-% to about 50 wt-%, from about 1 wt-% to about 40 wt-%, from about 5 wt-% to about 50 wt-%, from about 5 wt-% to about 40 wt-%, from about 10 wt-% to about 50 wt-%, from about 10 wt-% to about 40 wt-%, from about 15 wt-% to about 50 wt-%, from about 15 wt-% to about 40 wt-%, from about 20 wt-% to about 50 wt-%, from about 20 wt-% to about 40 wt-%, or less.

Polyols—Propylene Glycol or Glycerine

The cleaning compositions according to the disclosure include a polyol. Polyols, such as those containing from about 2 to about 6 carbon atoms, are the molecules that contain 2 or more hydroxyl (—OH) groups. Suitable polyols that can be used in the cleaning composition according to the disclosure include those molecules containing 2 to 6 carbon atoms and 2 to 6 hydroxyl groups, e.g., propylene glycol, ethylene glycol, glycerine, or 1,3-propanediol.

In some embodiments, the polyol of the cleaning compositions is propylene glycol. In some other embodiments, the polyol of the cleaning composition is glycerine. In yet some other embodiments, the polyol of the cleaning composition is a mixture of many suitable polyols.

In some embodiments, the polyol is present in a use solution of the cleaning composition or the cleaning composition itself in an amount of from about 5 wt-% to about 40 wt-%, from about 5 wt-% to about 35 wt-%, from about 5 wt-% to about 30 wt-%, from about 10 wt-% to about 30 wt-%, from about 10 wt-% to about 25 wt-%, or from about 10 wt-% to about 20 wt-%.

Alkyl Esters

The cleaning compositions according to the disclosure also contain an alkyl ester. One kind of exemplary alkyl esters include simple esters, such as, ethyl lactate, or ethyl 2-hydroxypropanoate, or lactic acid ethyl ester. Another kind of exemplary alkyl esters are polysorbates.

Polysorbate is an ester formed by the ethoxylation of sorbitan first, then the addition of lauric acid. It has a following general formula.

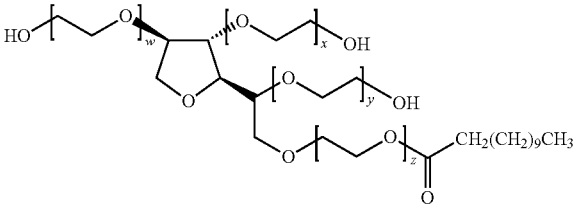

Exemplary polysorbates are polysorbate-20, 60, 80, and 85, whose commercial names are Tween®-20, Tween®-60, Tween®-80, and Tween®-85. The numbers after the name is the total repeat units (the sum of x+y+z+w in the above formula) of polyethylene glycol in the molecule and are distributed across 4 different chains.

In a preferred embodiment, the alkyl ester of the cleaning composition is ethyl lactate, or the decomposition products thereof—lactic acid and ethanol.

In another preferred embodiments, the alkyl ester of the cleaning composition is one or more polysorbates selected from the group of polysorbate-80, polysorbate-20, polysorbate-60, polysorbate-85, or a combination thereof. In some other embodiments, the alkyl ester of the cleaning composition is a polysorbate. In yet some other embodiments, the alkyl ester of the cleaning composition is polysorbate-80.

In some embodiments, the alkyl ester is present in a use solution of the cleaning composition or the cleaning composition itself in an amount of at least about 10 wt-% to about 50 wt-%, 10 wt-% to about 40 wt-%, at least about 15 wt-% to about 40 wt-%, at least about 15 wt-% to about 35 wt-%, or at least about 15 wt-% to about 30 wt-%.

Additional Functional Ingredients

The components of the cleaning composition can further be combined with various functional components suitable for use in aiding in the chewing gum removal according to the disclosure. In some embodiments, the cleaning composition including the diluent, polyol, and alkyl ester (and optionally water) make up a large amount, or even substantially all of the total weight of the cleaning composition. For example, in some embodiments few or no additional functional ingredients are disposed therein.

In other embodiments, additional functional ingredients may be included in the cleaning compositions. The functional ingredients provide desired properties and functionalities to the compositions. For the purpose of this application, the term "functional ingredient" includes a material that when dispersed or dissolved in a use and/or concentrate solution, such as an aqueous solution, provides a beneficial property in a particular use. Some particular examples of functional materials are discussed in more detail below, although the particular materials discussed are given by way of example only, and that a broad variety of other functional ingredients may be used.

In preferred embodiments, the compositions do not include D-limonene or the composition is substantially free of d-limonene. In other embodiments, the compositions do not include any components which are not GRAS as required for food contact and/or indirect food contact. In still other embodiments, the compositions do not include any components which impart an unfavorable odor and/or flavor. In still other embodiments, the compositions do not include any corrosion inhibitors. In still other embodiments, the compositions do not include any oil-based solvents. In still other embodiments, the compositions do not include any chelating agents. In still other embodiments, the compositions do not include any oxidizing agents. In still other embodiments, the compositions do not include any fluorine-based constituents. In still other embodiments, the compositions are terpene-free. In still other embodiments, the compositions do not include any of the following combinations of corrosion inhibitors, oil-based solvents, oxidizing agents, fluorine-based constituents and/or chelating agents and/or terpenes.

In some embodiments, the cleaning compositions includes one or more additional functional ingredients including fragrances, dyes, pH modifiers, such as buffers, additional solvents, or the like. In other embodiments, the cleaning compositions may include surfactants, defoaming agent, anti-redeposition agent, bleaching agent, solubility modifier, dispersant, rinse aid, metal protecting agent, stabilizing agent, chelating agent, rheology modifier or thickener, hydrotrope or coupler, buffer, solvent, a combination thereof.

Fragrances

The cleaning compositions can optionally include a fragrance. Various dyes, odorants including perfumes, and other aesthetic enhancing agents can also be included in the cleaning compositions.

Fragrances or perfumes that may be included in the compositions include, for example, terpenoids such as citronellol, aldehydes such as amyl cinnamaldehyde, a jasmine such as C1S-jasmine or jasmal, vanillin, and the like.

Dyes

The cleaning compositions can optionally include a dye.

Dyes can be included to alter the appearance of the composition, as for example, Direct Blue 86 (Miles), Fastusol Blue (Mobay Chemical Corp.), Acid Orange 7 (American Cyanamid), Basic Violet 10 (Sandoz), Acid Yellow 23 (GAF), Acid Yellow 17 (Sigma Chemical), Sap Green (Keyston Analine and Chemical), Metanil Yellow (Keystone Analine and Chemical), Acid Blue 9 (Hilton Davis), Sandolan Blue/Acid Blue 182 (Sandoz), Hisol Fast Red (Capitol Color and Chemical), Fluorescein (Capitol Color and Chemical), Acid Green 25 (Ciba-Geigy), and the like.

Buffers

The cleaning compositions can optionally include a buffer or pH modifier. "Buffered" means a liquid composition of matter characterized as containing a weak base and its conjugated acid or a weak acid and its congregated base in such an amount that it renders the liquid resistant to changes in pH.

The buffer is preferably the conjugate base of an acidulant used in the composition. Further, the buffer is preferably considered to be a GRAS or food additive raw material. The buffer can be added directly to the composition in the form of the salt of the acidulant or formed by adding a neutralizing base to the acidulant. For example, if the buffer is created in the composition then a neutralizing base should be added to the acidulant to form the corresponding buffering salt. The neutralizing base is preferably considered GRAS or food additive. Some non-limiting examples of suitable neutralizing bases include sodium hydroxide, potassium hydroxide, silicates, trisodiumphosphates and the like.

The buffer salts are preferably GRAS or food additive. Some non-limiting examples of suitable buffers include citric acid combined with sodium or potassium citrate, or phosphoric acid combined with monosodium phosphate, however, a person skilled in the art will be able to select the corresponding salt of the desired acidulant.

The buffer is preferably citric acid combined with sodium or potassium citrate.

The exact amount of the buffer in the composition will depend on the strength and amount of the acidulant and a person of ordinary skill in the art will be able to determine the exact weight percent of the buffer at equilibrium.

Alkalinity Sources

The cleaning compositions can optionally include an alkalinity source. In an aspect, the cleaning composition can include a neutral base. Examples of suitable alkaline sources include, but are not limited to carbonate-based alkalinity sources, including, for example, an alkali metal carbonate; caustic-based alkalinity sources, including, for example, alkali metal hydroxides; other suitable alkalinity sources may include metal silicate, metal borate, and organic alkalinity sources. Exemplary alkali metal carbonates that can be used include, but are not limited to, sodium carbonate, potassium carbonate, bicarbonate, sesquicarbonate, and mixtures thereof. Exemplary alkali metal hydroxides that can be used include, but are not limited to sodium, lithium, or potassium hydroxide. Exemplary metal silicates that can be used include, but are not limited to, sodium or potassium silicate or metasilicate. Exemplary metal borates include, but are not limited to, sodium or potassium borate.

Organic alkalinity sources are often strong nitrogen bases including, for example, ammonia (ammonium hydroxide), amines, alkanolamines, and amino alcohols. Typical examples of amines include primary, secondary or tertiary amines and diamines carrying at least one nitrogen linked hydrocarbon group, which represents a saturated or unsaturated linear or branched alkyl group having at least 10 carbon atoms and preferably 16-24 carbon atoms, or an aryl, aralkyl, or alkaryl group containing up to 24 carbon atoms, and wherein the optional other nitrogen linked groups are formed by optionally substituted alkyl groups, aryl group or aralkyl groups or polyalkoxy groups. Typical examples of alkanolamines include monoethanolamine, monopropanolamine, diethanolamine, dipropanolamine, triethanolamine, tripropanolamine and the like. Typical examples of amino alcohols include 2-amino-2-methyl-1-propanol, 2-amino-1-butanol, 2-amino-2-methyl-1,3-propanediol, 2-amino-2-ethyl-1,3-propanediol, hydroxymethyl aminomethane, and the like.

In some embodiments, the cleaning composition disclosed herein can include an alkali metal hydroxide, alkali metal carbonate, alkali metal bicarbonate, alkali metal sesquicarbonate, alkanolamine, metal silicate, metal metasilicate, or combination thereof. In some other embodiments, the cleaning composition disclosed herein can include an alkali metal hydroxide, alkali metal carbonate, alkali metal bicarbonate, or combination thereof. In yet some other embodiments, the cleaning composition disclosed herein can include an alkali metal carbonate, alkali metal bicarbonate; alkanolamine, metal silicate, metal metasilicate, or combination thereof.

Additional Solvents

The cleaning compositions can optionally include an additional solvent(s). Solvents are often useful in cleaning compositions to enhance soil removal properties. Suitable solvents include, but are not limited to: oxygenated solvents such as lower alkanols, lower alkyl ethers, glycols, aryl glycol ethers and lower alkyl glycol ethers. Examples of other solvents include, but are not limited to: methanol, ethanol, propanol, isopropanol and butanol, isobutanol, ethylene glycol, diethylene glycol, triethylene glycol, propylene glycol, dipropylene glycol, mixed ethylene-propylene glycol ethers, ethylene glycol phenyl ether, and propylene glycol phenyl ether.

Glycol ethers include, but are not limited to, diethylene glycol n-butyl ether, diethylene glycol n-propyl ether, diethylene glycol ethyl ether, diethylene glycol methyl ether, diethylene glycol t-butyl ether, dipropylene glycol n-butyl ether, dipropylene glycol methyl ether, dipropylene glycol ethyl ether, dipropylene glycol propyl ether, dipropylene glycol tert-butyl ether, ethylene glycol butyl ether, ethylene glycol propyl ether, ethylene glycol ethyl ether, ethylene glycol methyl ether, ethylene glycol methyl ether acetate, propylene glycol n-butyl ether, propylene glycol ethyl ether, propylene glycol methyl ether, propylene glycol n-propyl ether, tripropylene glycol methyl ether and tripropylene glycol n-butyl ether, ethylene glycol phenyl ether, propylene glycol phenyl ether, and the like, or mixtures thereof.

Surfactants

The cleaning compositions can optionally include one or more surfactants. In some embodiments, the cleaning composition may include an anionic, nonionic, amphoteric, zwitterionic, cationic surfactant, or combination thereof. In some other embodiments, the cleaning composition disclosed herein can optionally include one or more high-foaming surfactants. In yet another embodiments, the cleaning composition disclosed herein can optionally include one or more low-foaming or non-foaming surfactants.

Nonionic Surfactants

Suitable nonionic surfactants suitable for use with the compositions of the present disclosure include alkoxylated surfactants. Suitable alkoxylated surfactants include EO/PO copolymers, capped EO/PO copolymers, alcohol alkoxylates, capped alcohol alkoxylates, mixtures thereof, or the like. Suitable alkoxylated surfactants for use as solvents include EO/PO block copolymers, such as the Pluronic and reverse Pluronic surfactants; alcohol alkoxylates, such as Dehypon LS-54 ($R-(EO)_5(PO)_4$) and Dehypon LS-36 ($R-(EO)_3(PO)_6$); and capped alcohol alkoxylates, such as Plurafac LF221 and Tegoten EC11; mixtures thereof, or the like.

The semi-polar type of nonionic surface active agents is another class of nonionic surfactant useful in compositions of the present disclosure. Semi-polar nonionic surfactants include the amine oxides, phosphine oxides, sulfoxides and their alkoxylated derivatives.

Amine oxides are tertiary amine oxides corresponding to the general formula:

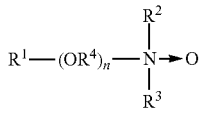

wherein the arrow is a conventional representation of a semi-polar bond; and, $R^1$, $R^2$, and $R^3$ may be aliphatic, aromatic, heterocyclic, alicyclic, or combinations thereof. Generally, for amine oxides of detergent interest, $R^1$ is an alkyl radical of from about 8 to about 24 carbon atoms; $R^2$ and $R^3$ are alkyl or hydroxyalkyl of 1-3 carbon atoms or a mixture thereof; $R^2$ and $R^3$ can be attached to each other, e.g. through an oxygen or nitrogen atom, to form a ring structure; $R^4$ is an alkylene or a hydroxyalkylene group containing 2 to 3 carbon atoms; and n ranges from 0 to about 20. An amine oxide can be generated from the corresponding amine and an oxidizing agent, such as hydrogen peroxide.

Useful water soluble amine oxide surfactants are selected from the octyl, decyl, dodecyl, isododecyl, coconut, or tallow alkyl di-(lower alkyl) amine oxides, specific examples of which are octyldimethylamine oxide, nonyldimethylamine oxide, decyldimethylamine oxide, undecyldimethylamine oxide, dodecyldimethylamine oxide, isododecyldimethyl amine oxide, tridecyldimethylamine oxide, tetradecyldimethylamine oxide, pentadecyldimethylamine oxide, hexadecyldimethylamine oxide, heptadecyldimethylamine oxide, octadecyldimethylaine oxide, dodecyldipropylamine oxide, tetradecyldipropylamine oxide, hexadecyldipropylamine oxide, tetradecyldibutylamine oxide, octadecyldibutylamine oxide, bis(2-hydroxyethyl)dodecylamine oxide, bis(2-hydroxyethyl)-3-dodecoxy-1-hydroxypropylamine oxide, dimethyl-(2-hydroxydodecyl) amine oxide, 3,6,9-trioctadecyldimethylamine oxide and 3-dodecoxy-2-hydroxypropyldi-(2-hydroxyethyl)amine oxide.

Anionic Surfactants

Anionic sulfate surfactants suitable for use in the present compositions include alkyl ether sulfates, alkyl sulfates, the linear and branched primary and secondary alkyl sulfates, alkyl ethoxysulfates, fatty oleyl glycerol sulfates, alkyl phenol ethylene oxide ether sulfates, the $C_5$-$C_{17}$ acyl-N—($C_1$-$C_4$ alkyl) and —N—($C_1$-$C_2$ hydroxyalkyl) glucamine sulfates, and sulfates of alkylpolysaccharides such as the sulfates of alkylpolyglucoside, and the like. Also included are the alkyl sulfates, alkyl poly(ethyleneoxy) ether sulfates and aromatic poly(ethyleneoxy) sulfates such as the sulfates or condensation products of ethylene oxide and nonyl phenol (usually having 1 to 6 oxyethylene groups per molecule).

Anionic sulfonate surfactants suitable for use in the present compositions also include alkyl sulfonates, the linear and branched primary and secondary alkyl sulfonates, and the aromatic sulfonates with or without substituents.

Anionic carboxylate surfactants suitable for use in the present compositions include carboxylic acids (and salts), such as alkanoic acids (and alkanoates), ester carboxylic acids (e.g. alkyl succinates), ether carboxylic acids, and the like. Such carboxylates include alkyl ethoxy carboxylates, alkyl aryl ethoxy carboxylates, alkyl polyethoxy polycarboxylate surfactants and soaps (e.g. alkyl carboxyls). Secondary carboxylates useful in the present compositions include those which contain a carboxyl unit connected to a secondary carbon. The secondary carbon can be in a ring structure, e.g. as in p-octyl benzoic acid, or as in alkyl-substituted cyclohexyl carboxylates. The secondary carboxylate surfactants typically contain no ether linkages, no ester linkages and no hydroxyl groups. Further, they typically lack nitrogen atoms in the head-group (amphiphilic portion). Suitable secondary soap surfactants typically contain 11-13 total carbon atoms, although more carbons atoms (e.g., up to 16) can be present. Suitable carboxylates also include acylamino acids (and salts), such as acylgluamates, acyl peptides, sarcosinates (e.g. N-acyl sarcosinates), taurates (e.g. N-acyl taurates and fatty acid amides of methyl tauride), and the like.

Suitable anionic surfactants include alkyl or alkylaryl ethoxy carboxylates of the following formula:

$$R—O—(CH_2CH_2O)_m(CH_2)_m—CO_2X \quad (3)$$

in which R is a $C_8$ to $C_{22}$ alkyl group or

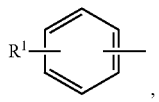

in which $R^1$ is a $C_4$-$C_{16}$ alkyl group;

n is an integer of 1-20; m is an integer of 1-3; and X is a counter ion, such as hydrogen, sodium, potassium, lithium, ammonium, or an amine salt such as monoethanolamine, diethanolamine or triethanolamine. In some embodiments, n is an integer of 4 to 10 and m is 1. In some embodiments, R is a $C_8$-$C_{16}$ alkyl group. In some embodiments, R is a $C_{12}$-$C_{14}$ alkyl group, n is 4, and m is 1.

In other embodiments, R is

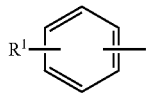

and $R^1$ is a $C_6$-$C_{12}$ alkyl group. In still yet other embodiments, $R^1$ is a $C_9$ alkyl group, n is 10 and m is 1.

Such alkyl and alkylaryl ethoxy carboxylates are commercially available. These ethoxy carboxylates are typically available as the acid forms, which can be readily converted to the anionic or salt form. Commercially available carboxylates include, Neodox 23-4, a $C_{12-13}$ alkyl polyethoxy (4) carboxylic acid (Shell Chemical), and Emcol CNP-110, a $C_9$ alkylaryl polyethoxy (10) carboxylic acid (Witco Chemical). Carboxylates are also available from Clariant, e.g. the product Sandopan® DTC, a $C_{13}$ alkyl polyethoxy (7) carboxylic acid.

Amphoteric Surfactants

Amphoteric, or ampholytic, surfactants contain both a basic and an acidic hydrophilic group and an organic hydrophobic group. These ionic entities may be any of anionic or cationic groups described herein for other types of surfactants. A basic nitrogen and an acidic carboxylate group are the typical functional groups employed as the basic and acidic hydrophilic groups. In a few surfactants, sulfonate, sulfate, phosphonate or phosphate provide the negative charge.

Amphoteric surfactants can be broadly described as derivatives of aliphatic secondary and tertiary amines, in which the aliphatic radical may be straight chain or branched and wherein one of the aliphatic substituents contains from about 8 to 18 carbon atoms and one contains an anionic water solubilizing group, e.g., carboxy, sulfo, sulfato, phosphato, or phosphono. Amphoteric surfactants are subdivided into two major classes known to those of skill in the art and described in "Surfactant Encyclopedia" Cosmetics & Toiletries, Vol. 104 (2) 69-71 (1989), which is herein incorporated by reference in its entirety. The first class includes acyl/dialkyl ethylenediamine derivatives (e.g. 2-alkyl hydroxyethyl imidazoline derivatives) and their salts. The second class includes N-alkylamino acids and their salts. Some amphoteric surfactants can be envisioned as fitting into both classes.

Amphoteric surfactants can be synthesized by methods known to those of skill in the art. For example, 2-alkyl hydroxyethyl imidazoline is synthesized by condensation and ring closure of a long chain carboxylic acid (or a derivative) with dialkyl ethylenediamine. Commercial amphoteric surfactants are derivatized by subsequent hydrolysis and ring-opening of the imidazoline ring by alkylation—for example with chloroacetic acid or ethyl acetate. During alkylation, one or two carboxy-alkyl groups react to form a tertiary amine and an ether linkage with differing alkylating agents yielding different tertiary amines.

Long chain imidazole derivatives having application in the present disclosure generally have the general formula:

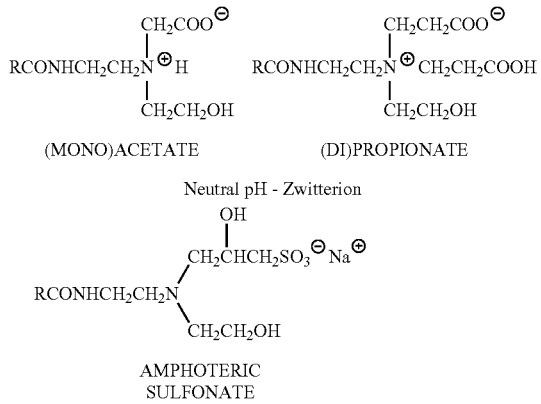

wherein R is an acyclic hydrophobic group containing from about 8 to 18 carbon atoms and M is a cation to neutralize the charge of the anion, generally sodium. Commercially prominent imidazoline-derived amphoterics that can be employed in the present compositions include for example:

Cocoamphopropionate, Cocoamphocarboxy-propionate, Cocoamphoglycinate, Cocoamphocarboxy-glycinate, Cocoamphopropyl-sulfonate, and Cocoamphocarboxy-propionic acid. Amphocarboxylic acids can be produced from fatty imidazolines in which the dicarboxylic acid functionality of the amphodicarboxylic acid is diacetic acid and/or dipropionic acid.

The carboxymethylated compounds (glycinates) described herein above frequently are called betaines. Betaines are a special class of amphoteric discussed herein below in the section entitled, Zwitterion Surfactants.

Long chain N-alkylamino acids are readily prepared by reaction $RNH_2$, in which R=$C_8$-$C_{18}$ straight or branched chain alkyl, fatty amines with halogenated carboxylic acids. Alkylation of the primary amino groups of an amino acid leads to secondary and tertiary amines. Alkyl substituents may have additional amino groups that provide more than one reactive nitrogen center. Most commercial N-alkylamine acids are alkyl derivatives of beta-alanine or beta-N(2-carboxyethyl) alanine. Examples of commercial N-alkylamino acid ampholytes having application in this disclosure include alkyl beta-amino dipropionates, $RN(C_2H_4COOM)_2$ and $RNHC_2H_4COOM$. In an embodiment, R can be an acyclic hydrophobic group containing from about 8 to about 18 carbon atoms, and M is a cation to neutralize the charge of the anion.

Suitable amphoteric surfactants include those derived from coconut products such as coconut oil or coconut fatty acid. Additional suitable coconut derived surfactants include as part of their structure an ethylenediamine moiety, an alkanolamide moiety, an amino acid moiety, e.g., glycine, or a combination thereof; and an aliphatic substituent of from about 8 to 18 (e.g., 12) carbon atoms. Such a surfactant can also be considered an alkyl amphodicarboxylic acid. These amphoteric surfactants can include chemical structures represented as: $C_{12}$-alkyl-C(O)—NH—$CH_2$—$CH_2$—$N^+(CH_2—CH_2—CO_2Na)_2$—$CH_2$—$CH_2$—OH or $C_{12}$-alkyl-C(O)—N(H)—$CH_2$—$CH_2$—$N^+(CH_2—CO_2Na)_2$—$CH_2$—$CH_2$—OH. Disodium cocoampho dipropionate is one suitable amphoteric surfactant and is commercially available under the tradename Miranol™ FBS from Rhodia Inc., Cranbury, N.J. Another suitable coconut derived amphoteric surfactant with the chemical name disodium cocoampho diacetate is sold under the tradename Mirataine™ JCHA, also from Rhodia Inc., Cranbury, N.J.

A typical listing of amphoteric classes, and species of these surfactants, is given in U.S. Pat. No. 3,929,678 issued to Laughlin and Heuring on Dec. 30, 1975. Further examples are given in "Surface Active Agents and Detergents" (Vol. I and II by Schwartz, Perry and Berch).

Zwitterionic Surfactants

Zwitterionic surfactants can be thought of as a subset of the amphoteric surfactants and can include an anionic charge. Zwitterionic surfactants can be broadly described as derivatives of secondary and tertiary amines, derivatives of heterocyclic secondary and tertiary amines, or derivatives of quaternary ammonium, quaternary phosphonium or tertiary sulfonium compounds. Typically, a zwitterionic surfactant includes a positive charged quaternary ammonium or, in some cases, a sulfonium or phosphonium ion; a negative charged carboxyl group; and an alkyl group. Zwitterionics generally contain cationic and anionic groups which ionize to a nearly equal degree in the isoelectric region of the molecule and which can develop strong "inner-salt" attraction between positive-negative charge centers. Examples of such zwitterionic synthetic surfactants include derivatives of aliphatic quaternary ammonium, phosphonium, and sulfonium compounds, in which the aliphatic radicals can be straight chain or branched, and wherein one of the aliphatic substituents contains from 8 to 18 carbon atoms and one contains an anionic water solubilizing group, e.g., carboxy, sulfonate, sulfate, phosphate, or phosphonate.

Betaine and sultaine surfactants are exemplary zwitterionic surfactants for use herein. A general formula for these compounds is:

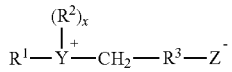

wherein $R^1$ contains an alkyl, alkenyl, or hydroxyalkyl radical of from 8 to 18 carbon atoms having from 0 to 10 ethylene oxide moieties and from 0 to 1 glyceryl moiety; Y is selected from the group consisting of nitrogen, phosphorus, and sulfur atoms; $R^2$ is an alkyl or monohydroxy alkyl group containing 1 to 3 carbon atoms; x is 1 when Y is a sulfur atom and 2 when Y is a nitrogen or phosphorus atom, $R^3$ is an alkylene or hydroxy alkylene or hydroxy alkylene of from 1 to 4 carbon atoms and Z is a radical selected from the group consisting of carboxylate, sulfonate, sulfate, phosphonate, and phosphate groups.

Examples of zwitterionic surfactants having the structures listed above include: 4-[N,N-di(2-hydroxyethyl)-N-octadecylammonio]-butane-1-carboxylate; 5-[S-3-hydroxypropyl-S-hexadecylsulfonio]-3-hydroxypentane-1-sulfate; 3-[P,P-diethyl-P-3,6,9-trioxatetracosanephosphonio]-2-hydroxypropane-1-phosphate; 3-[N,N-dipropyl-N-3-dodecoxy-2-hydroxypropyl-ammonio]-propane-1-phosphonate; 3-(N,N-dimethyl-N-hexadecylammonio)-propane-1-sulfonate; 3-(N,N-dimethyl-N-hexadecylammonio)-2-hydroxy-propane-1-sulfonate; 4-[N,N-di(2(2-hydroxy ethyl)-N(2-hydroxy dodecyl)ammonio]-butane-1-carboxylate; 3-[S-ethyl-S-(3-dodecoxy-2-hydroxypropyl)sulfonio]-propane-1-phosphate; 3-[P,P-dimethyl-P-dodecylphosphonio]-propane-1-phosphonate; and S[N,N-di(3-hydroxypropyl)-N-hexadecylammonio]-2-hydroxy-pentane-1-sulfate. The alkyl groups contained in said detergent surfactants can be straight or branched and saturated or unsaturated.

The zwitterionic surfactant suitable for use in the present compositions includes a betaine of the general structure:

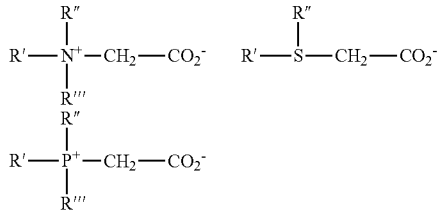

These surfactant betaines typically do not exhibit strong cationic or anionic characters at pH extremes nor do they show reduced water solubility in their isoelectric range. Unlike "external" quaternary ammonium salts, betaines are compatible with anionics. Examples of suitable betaines include coconut acylamidopropyldimethyl betaine; hexadecyl dimethyl betaine; $C_{12-14}$ acylamidopropylbetaine; $C_{8-14}$ acylamidohexyldiethyl betaine; 4-$C_{14-16}$ acylmethylamidodiethylammonio-1-carboxybutane; $C_{16-18}$ acylamidodimethylbetaine; $C_{12-16}$ acylamidopentanediethylbetaine; and $C_{12-16}$ acylmethylamidodimethylbetaine.

Sultaines useful in the present disclosure include those compounds having the formula $(R(R^1)_2N^+R^2SO^{3-}$, in which R is a $C_6$-$C_{18}$ hydrocarbyl group, each $R^1$ is typically independently $C_1$-$C_3$ alkyl, e.g. methyl, and $R^2$ is a $C_1$-$C_6$ hydrocarbyl group, e.g. a $C_1$-$C_3$ alkylene or hydroxyalkylene group.

A typical listing of zwitterionic classes, and species of these surfactants, is given in U.S. Pat. No. 3,929,678 issued to Laughlin and Heuring on Dec. 30, 1975. Further examples are given in "Surface Active Agents and Detergents" (Vol. I and II by Schwartz, Perry and Berch). Each of these references is herein incorporated in their entirety.

In an embodiment, the compositions of the present disclosure include a betaine. For example, the compositions can include cocoamido propyl betaine.

Cationic Surfactants

Cationic surfactants preferably include, more preferably refer to, compounds containing at least one long carbon chain hydrophobic group and at least one positively charged nitrogen. The long carbon chain group may be attached directly to the nitrogen atom by simple substitution; or more preferably indirectly by a bridging functional group or groups in so-called interrupted alkylamines and amido amines. Such functional groups can make the molecule more hydrophilic and/or more water dispersible, more easily water solubilized by co-surfactant mixtures, and/or water soluble. For increased water solubility, additional primary, secondary or tertiary amino groups can be introduced or the amino nitrogen can be quaternized with low molecular weight alkyl groups. Further, the nitrogen can be a part of branched or straight chain moiety of varying degrees of unsaturation or of a saturated or unsaturated heterocyclic ring. In addition, cationic surfactants may contain complex linkages having more than one cationic nitrogen atom.

The surfactant compounds classified as amine oxides, amphoterics and zwitterions are themselves typically cationic in near neutral to acidic pH solutions and can overlap surfactant classifications. Polyoxyethylated cationic surfactants generally behave like nonionic surfactants in alkaline solution and like cationic surfactants in acidic solution.

The simplest cationic amines, amine salts and quaternary ammonium compounds can be schematically drawn thus:

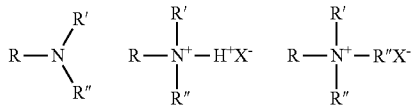

in which, R represents a long alkyl chain, R', R'', and R''' may be either long alkyl chains or smaller alkyl or aryl groups or hydrogen and X represents an anion. The amine salts and quaternary ammonium compounds are preferred for practical use in this disclosure due to their high degree of water solubility.

The majority of large volume commercial cationic surfactants can be subdivided into four major classes and additional sub-groups known to those or skill in the art and described in "Surfactant Encyclopedia", *Cosmetics & Toiletries*, Vol. 104 (2) 86-96 (1989). The first class includes alkylamines and their salts. The second class includes alkyl imidazolines. The third class includes ethoxylated amines. The fourth class includes quaternaries, such as alkylbenzyldimethylammonium salts, alkyl benzene salts, heterocyclic ammonium salts, tetra alkylammonium salts, and the like. Cationic surfactants are known to have a variety of properties that can be beneficial in the present compositions. These desirable properties can include detergency in compositions of or below neutral pH, antimicrobial efficacy, thickening or gelling in cooperation with other agents, and the like.

Cationic surfactants useful in the compositions of the present disclosure include those having the formula $R^1{}_mR^2{}_xY_LZ$ wherein each $R^1$ is an organic group containing a straight or branched alkyl or alkenyl group optionally substituted with up to three phenyl or hydroxy groups and optionally interrupted by up to four of the following structures:

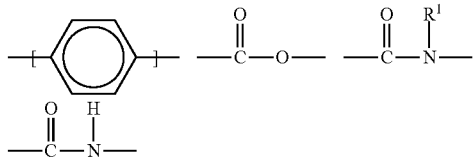

or an isomer or mixture of these structures, and which contains from about 8 to 22 carbon atoms. The $R^1$ groups can additionally contain up to 12 ethoxy groups. m is a number from 1 to 3. Preferably, no more than one $R^1$ group in a molecule has 16 or more carbon atoms when m is 2 or more than 12 carbon atoms when m is 3. Each $R^2$ is an alkyl or hydroxyalkyl group containing from 1 to 4 carbon atoms or a benzyl group with no more than one $R^2$ in a molecule being benzyl, and x is a number from 0 to 11, preferably from 0 to 6. The remainder of any carbon atom positions on the Y group are filled by hydrogens.

Y is can be a group including, but not limited to:

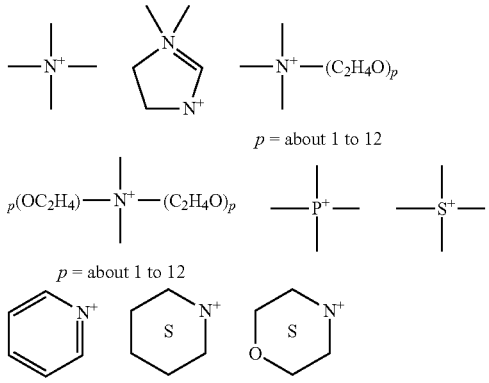

or a mixture thereof. Preferably, L is 1 or 2, with the Y groups being separated by a moiety selected from $R^1$ and $R^2$ analogs (preferably alkylene or alkenylene) having from 1 to about 22 carbon atoms and two free carbon single bonds when L is 2. Z is a water-soluble anion, such as a halide, sulfate, methylsulfate, hydroxide, or nitrate anion, particularly preferred being chloride, bromide, iodide, sulfate or methyl sulfate anions, in a number to give electrical neutrality of the cationic component.

Methods of Use

The methods of employing the cleaning compositions are suitable for applications of use in various applications for removing sticky type soils from a variety of surfaces.

Exemplary applications include, for example, removing chewing gum, chewing gum residues and other sugary and/or sticky soils from surfaces, cleaning confectionery surfaces, fryer cleaning, medical adhesive removal, nail polish removal, makeup and personal care product removal, and the like.

In an aspect, the cleaning compositions provides a suitable no-rinse application of use to remove chewing gum, chewing gum residues and other sugary and/or sticky soils from surfaces, namely hard surfaces. In an aspect, the methods are directed to removing such soils from food processing and production equipment and related surfaces.

In an aspect, the methods comprise, consist of and/or consist essentially of contacting a soiled surface with the cleaning composition according to the disclosure. The contacting step is provided for a sufficient amount of time to loosen and remove the chewing gum, chewing gum residue and/or other soils from the surface. In an aspect, the contacting step is for a few seconds to a few hours, for a few seconds to a few minutes. In some aspects, the contacting sufficient for removal is within about 2 hours or less, 1 hour or less, 55 minutes or less, 50 minutes or less, 45 minutes or less, 40 minutes or less, 35 minutes or less, 30 minutes or less, 25 minutes or less, 20 minutes or less, 15 minutes or less, 10 minutes or less, 9 minutes or less, 8 minutes or less, 7 minutes or less, 6 minutes or less, 5 minutes or less, 4 minutes or less, 3 minutes or less, 2 minutes or less, or 1 minute or less. In some respects, the contacting sufficient for removal is within about 180 seconds or less, 120 seconds or less, 90 seconds or less, 60 seconds or less, 45 seconds or less, 40 seconds or less, 35 seconds or less, 30 seconds or less, 25 seconds or less, 20 seconds or less, 15 seconds or less, 10 seconds or less, or 5 seconds or less.

In a preferred aspect, the contacting is from 30 seconds to 5 minutes, or from 1 minute to 2 minutes.

In an aspect, contacting is accomplished by spraying, immersing, pouring, or otherwise applying the cleaning composition to the solid surface. One skilled in the art understands that the cleaning composition can be applied by a variety of conventional spraying or contacting mechanisms without limiting the scope of the disclosure.

In a further aspect, the methods comprise, consist of and/or consist essentially of removing (or scraping off) chewing gum from a soiled surface and contacting the soiled surface with the cleaning composition according to the disclosure to remove any further chewing gum residue and/or other sugary and/or sticky soils from the surface. In other aspects, the methods may further include a wiping step after the soiled surface is contacted with the cleaning composition. Beneficially, the methods do not require a rinse step to completely remove the cleaning composition from the surface.

In an alternative aspect, the cleaning compositions can optionally employ a rinse step. However, as set forth according to the benefits of the disclosure, the rinse step is not required as the cleaning compositions according to the disclosure provide food-safe (or GRAS) compositions and any residual cleaning composition would not interfere with subsequent food processing and/or production.

In an aspect, the pH of the cleaning composition for use according to the disclosure is about 3 to about 12, about 12 or less, about 11 or less, about 10 or less, about 9 or less, about 8 or less, or about 7.

The contacting of the cleaning composition can occur at any suitable temperature, including ambient temperatures for the food processing or production process to which the surface relates. In an aspect, the temperature is between about 50° F. and about 120° F., between about 60° F. and about 100° F., between about 70° F. and about 90° F., or between about 70° F. and about 80° F.

The methods of disclosure can beneficially not require use of excess mechanical force to remove chewing gum or other sticky substances. In other aspects, the methods do not require excess mechanical force and/or steam and/or high pressure (or heat jet streams) and/or cryogenic freezing to remove chewing gum or other sticky substances.

All publications and patent applications in this specification are indicative of the level of ordinary skill in the art to which this disclosure pertains. All publications and patent applications are herein incorporated by reference to the same extent as if each individual publication or patent application was specifically and individually indicated as incorporated by reference.

EXAMPLES

Embodiments of the present disclosure are further defined in the following non-limiting Examples. It should be understood that these Examples, while indicating certain embodiments of the disclosure, are given by way of illustration only. From the above discussion and these Examples, one skilled in the art can ascertain the essential characteristics of this disclosure, and without departing from the spirit and scope thereof, can make various changes and modifications of the embodiments of the disclosure to adapt it to various usages and conditions. Thus, various modifications of the embodiments of the disclosure, in addition to those shown and described herein, will be apparent to those skilled in the art from the foregoing description. Such modifications are also intended to fall within the scope of the appended claims.

The following materials were employed in the cleaning compositions and control compositions evaluated:

| Name | IUPAC |
|---|---|
| Glycerine, 96% | Propane-1,2,3-triol |
| Citrofol A I | Triethyl citrate |
| Citrofol B II | Tributyl O-acetylcitrate |
| Dehydol ® LS 3 DEO N | Laureth-3 |
| Ethyl Lactate | Ethyl 2-hydroxypropanoate |
| Isopropanol | 2-Propanol |
| Propylene Glycol | Propane-1,2-diol |
| Sensiva SC 50 | 3-(2-ethylhexyloxy)propane-1,2-diol |
| Sugar Residue Digestant | N/A |

Example 1

A scrape-spray-wipe procedure was utilized to validate the cleaning ability of the formulations as provided below in Examples 1-5 of Table 2; Examples 6-10 of Table 3; and Examples 11-15 of Table 4. The numerous formulations were tested using either a scrape-spray-wipe or static soak methods to remove the various chewing gum products.

In the evaluation, 1-inch by 3-inch stainless steel (SS) cleaning validation coupons were warmed on a hotplate. Once warm, gum of various types and flavors was added to the coupons and allowed to soften. The coupons with gum were allowed to cool to room temperature, then the gum was removed from each coupon with a spatula. Two controls were used; one coupon was sprayed with water, and another coupon was sprayed with D-Limonene (positive control). Each of the remaining coupons were sprayed with the formulation of the given Example, then wiped with a paper towel.

TABLE 2

| | Example 1 | | Example 2 | | Example 3 | | Example 4 | | Example 5 | |
|---|---|---|---|---|---|---|---|---|---|---|
| Material | Wt., g | Wt. % | Wt., g | Wt. % | Wt., g | Wt. % | Wt., g | Wt. % | Wt., g | Wt. % |
| Water Zeolite Softened | 19.80 | 39.38 | | | | | 1.61 | 15.88 | 3.05 | 30.41 |
| Glycerine, 96% | 10.18 | 20.25 | | | | | 5.81 | 57.30 | 4.65 | 46.36 |
| Citrofol A I | | | 7.03 | 69.74 | 0.00 | 0.00 | 0.00 | 0.00 | 0.00 | 0.00 |
| Propylene Glycol | 7.54 | 15.00 | | | | | 1.41 | 13.91 | 1.02 | 10.17 |
| Ethyl Lactate | 12.76 | 25.38 | | | 7.16 | 69.79 | 0.80 | 7.89 | 0.80 | 7.98 |
| Sensiva SC 50 (Ethyl hexyl glycerine) | | | 2.53 | 25.10 | 1.01 | 9.84 | 0.51 | 5.03 | 0.51 | 5.08 |
| Sugar Residue Digestant | | | | | 2.09 | 20.37 | 0.00 | 0.00 | 0.00 | 0.00 |
| Dehydol ® LS 3 DEO N | | | 0.52 | 5.16 | | | | | | |

TABLE 3

| | Example 6 | | Example 7 | | Example 8 | | Example 9 | | Example 10 | |
|---|---|---|---|---|---|---|---|---|---|---|
| Material | Wt., g | Wt. % | Wt., g | Wt. % | Wt., g | Wt. % | Wt., g | Wt. % | Wt., g | Wt. % |
| Water Zeolite Softened TNK | 3.96 | 39.52 | 2.73 | 27.16 | 1.01 | 10.08 | 1.07 | 10.69 | 1.03 | 10.25 |
| Glycerine, 96% | 2.02 | 20.16 | 2.26 | 22.49 | 3.50 | 34.93 | 2.50 | 24.98 | 4.92 | 48.96 |
| Cytosol B II | | | 2.54 | 25.27 | 2.49 | 24.85 | 3.38 | 33.77 | | |
| Propylene Glycol | 1.51 | 15.07 | 0.79 | 7.86 | 0.74 | 7.39 | 1.53 | 15.28 | 1.55 | 15.42 |
| Ethyl Lactate | 2.53 | 25.25 | 1.01 | 10.05 | 1.51 | 15.07 | | | 2.55 | 25.37 |
| Isopropanol | | | 0.72 | 7.16 | 0.77 | 7.68 | 1.01 | 10.09 | | |
| Pensive SC 50 (Ethyl hexyl glycerine) | | | | | | | 0.52 | 5.19 | | |

TABLE 4

| | Example 11 | | Example 12 | | Example 13 | | Example 14 | | Example 15 | |
|---|---|---|---|---|---|---|---|---|---|---|
| Material | Wt., g | Wt. % | Wt., g | Wt. % | Wt., g | Wt. % | Wt., g | Wt. % | Wt., g | Wt. % |
| Water Zeolite Softened TNK | 200.05 | 39.93 | 0.00 | 0.00 | 0.00 | 0.00 | 0.00 | 0.00 | 160.03 | 53.33 |
| Kosher Glycerine, 99.5% | 100.06 | 19.97 | 166.30 | 33.20 | 250.54 | 50.03 | 300.34 | 60.00 | 80.03 | 26.67 |
| Propylene Glycol, USP | 75.06 | 14.98 | 125.05 | 24.97 | 125.08 | 24.98 | 125.15 | 25.00 | 60.04 | 20.01 |
| Ethyl Lactate | 125.81 | 25.11 | 209.53 | 41.83 | 125.16 | 24.99 | 75.09 | 15.00 | 0 | 0.00 |
| Lactic Acid | | | | | | | | | 50.10 | 16.69 |
| Ethyl Alcohol | | | | | | | | | 50.06 | 16.68 |

The results are shown in FIGS. 1-9 as outlined here in more detail.

Figure 1B:
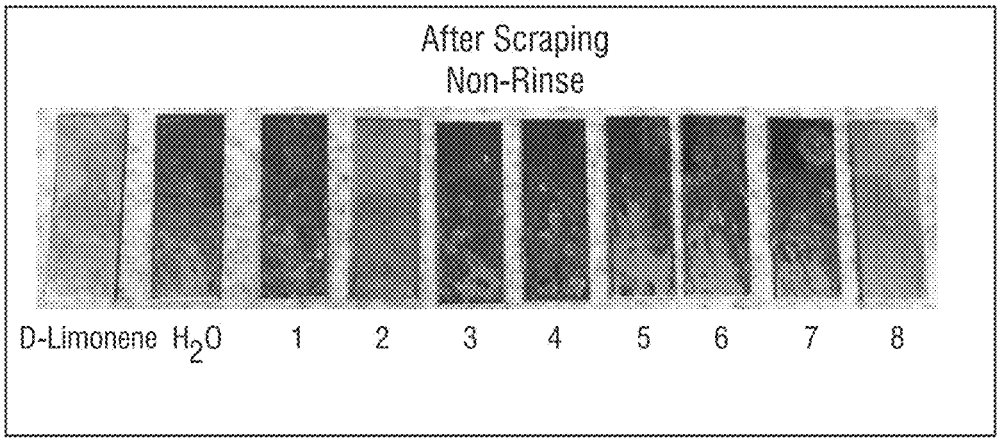
Figure 1C:
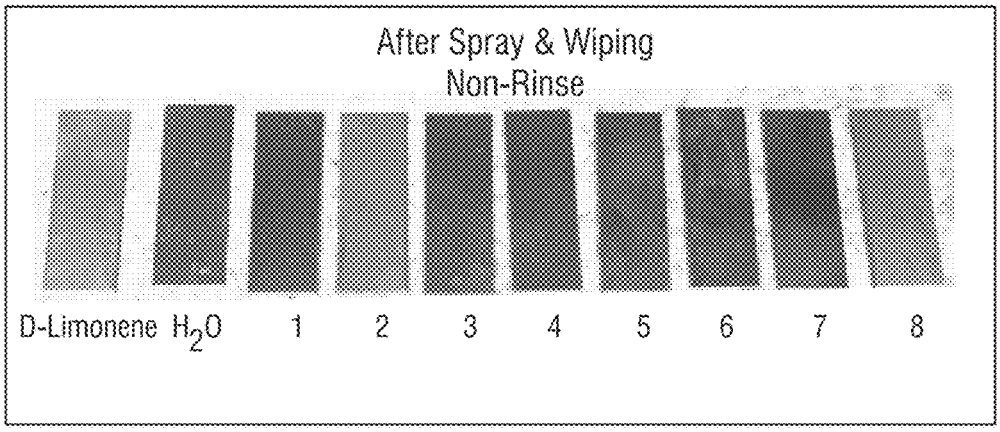

FIGS. 1A-C show the evaluated fresh mint flavored gum with eight experimental formulas (Examples 1-8) as well as soft water (negative control) and D-Limonene (positive control). FIG. 1A shows the coupons with gum before scraping, FIG. 1B shows the coupons after scraping and still containing gum residue, and FIG. 1C shows the coupons after spray of the eight experimental formulas/controls and wiping. As is visually evident, the cleaning composition of Examples 1-8 provided formulation benefits that were successful in removing gum from the solid coupons. The evaluated formulas provide at least equal to or improved performance in comparison to D-Limonene and better than water (negative control), providing further interest in utilization of cleaning composition solutions that do not require a rinse in commercial applications due to GRAS or food safe nature of components of the composition.

Figure 2A:
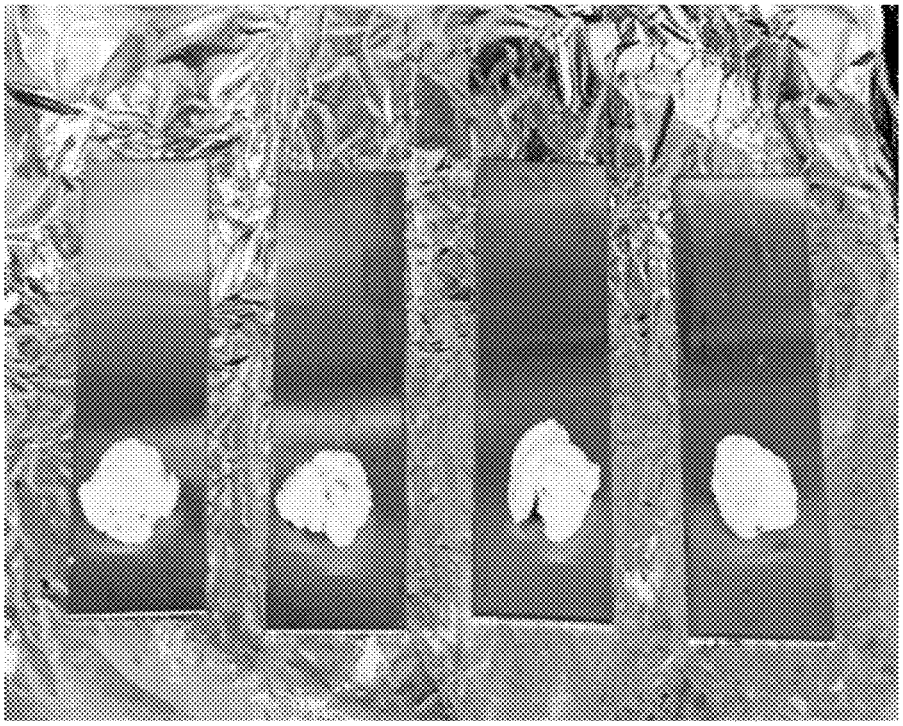
FIGS. 2A-D show phases of gum removal evaluation employing Example 1 formulation on a fresh mint flavored gum.
Figure 2B:
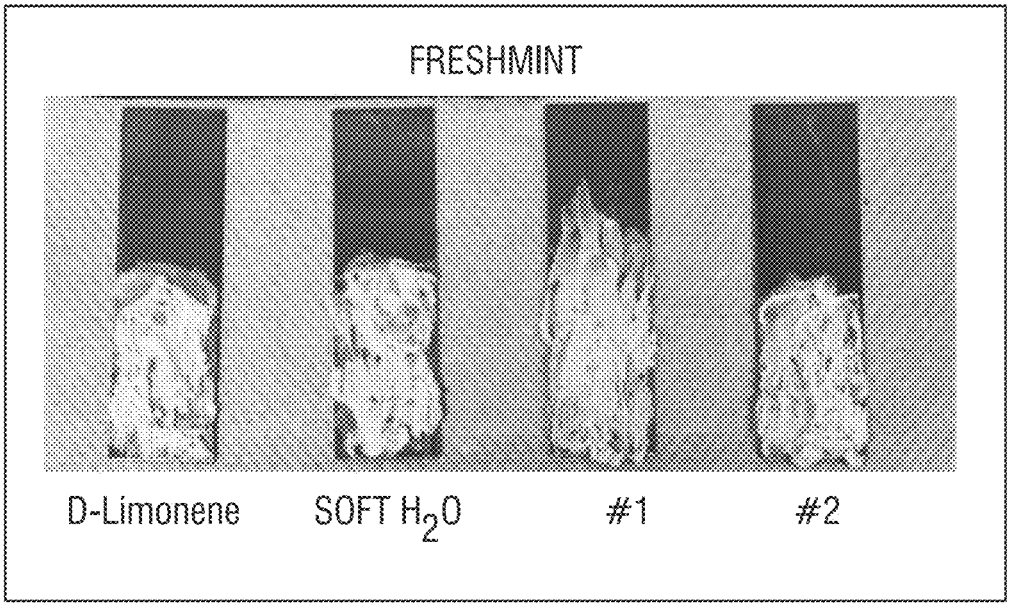
Figure 2C:
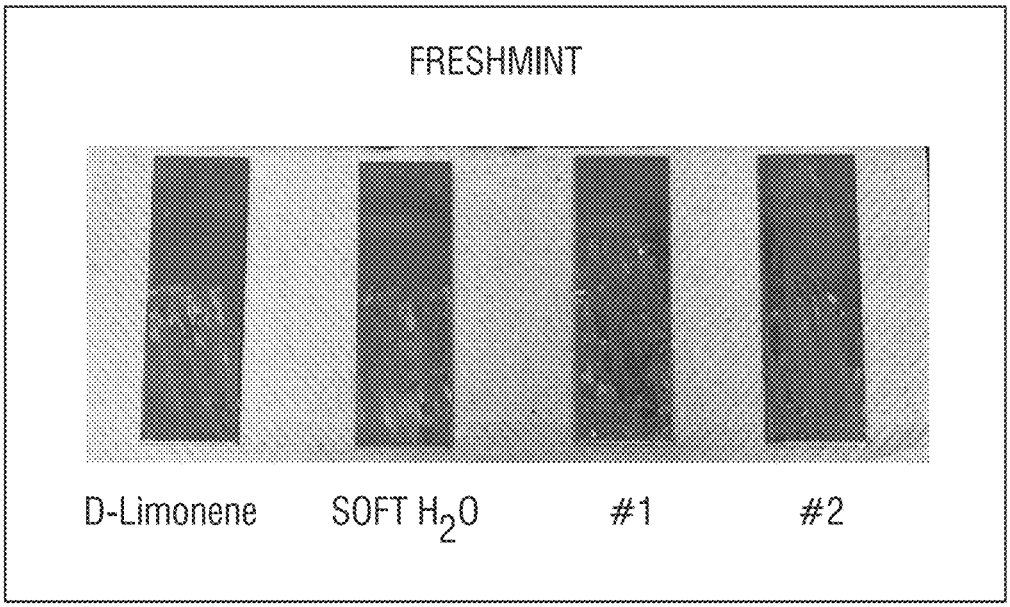
Figure 2D:
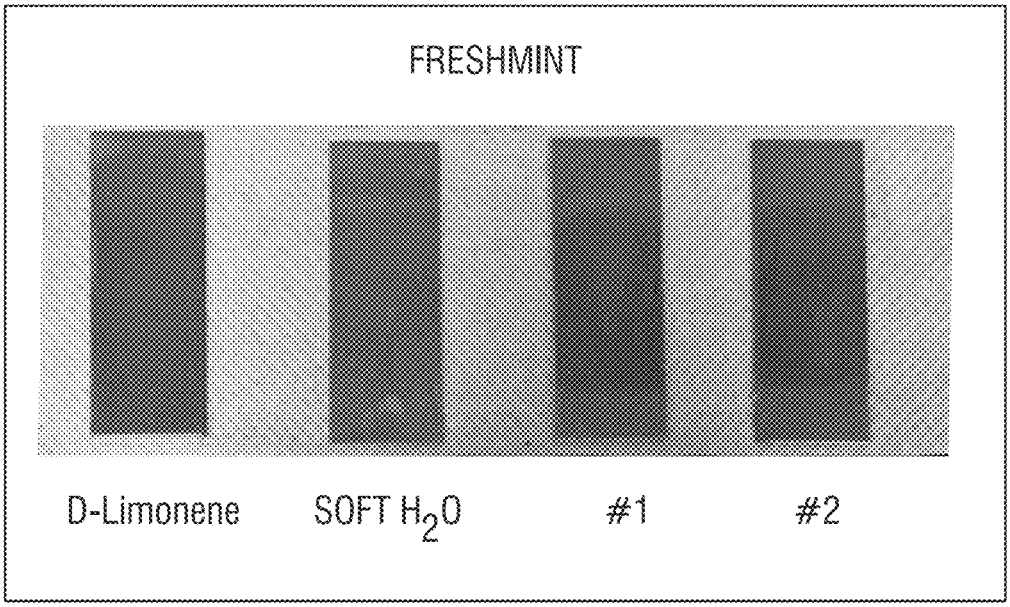

FIGS. 2A-C show gum removal experiments evaluating the Example 1 formulation on the fresh mint flavored gum. FIG. 2A shows the gum on the coupons before melting, FIG. 2B shows the coupons with gum before scraping, FIG. 2C shows the coupons after scraping and still containing gum residue, and FIG. 2D shows the coupons after spray of the experimental formula/controls and wiping. The evaluated formula shown as Example 1 demonstrated gum removal superior to controls.

Figure 3A:
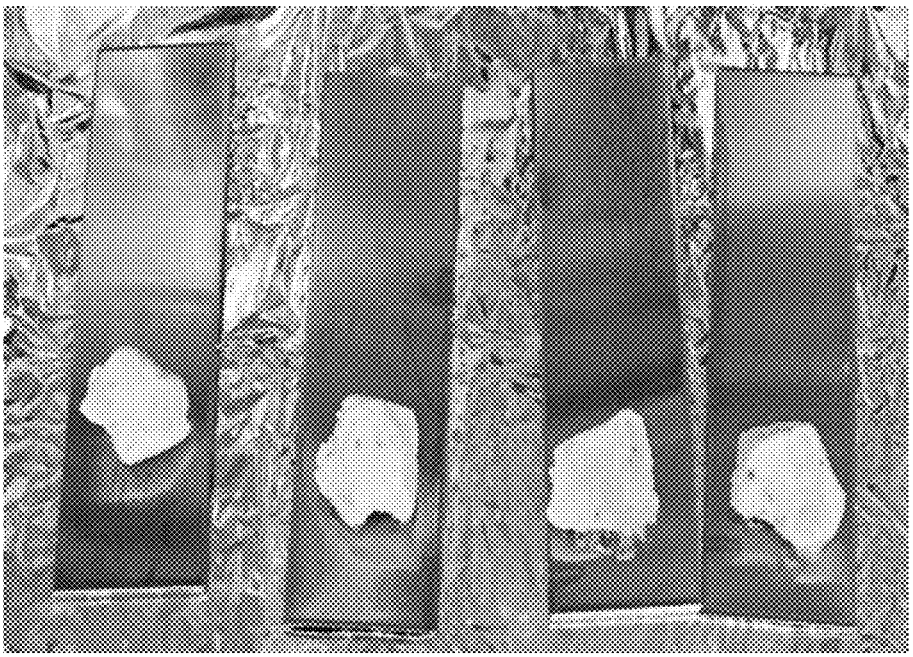
FIGS. 3A-D show phases of gum removal evaluation employing Example 1 formulation on the strawberry/villa flavored gum.
Figure 3B:
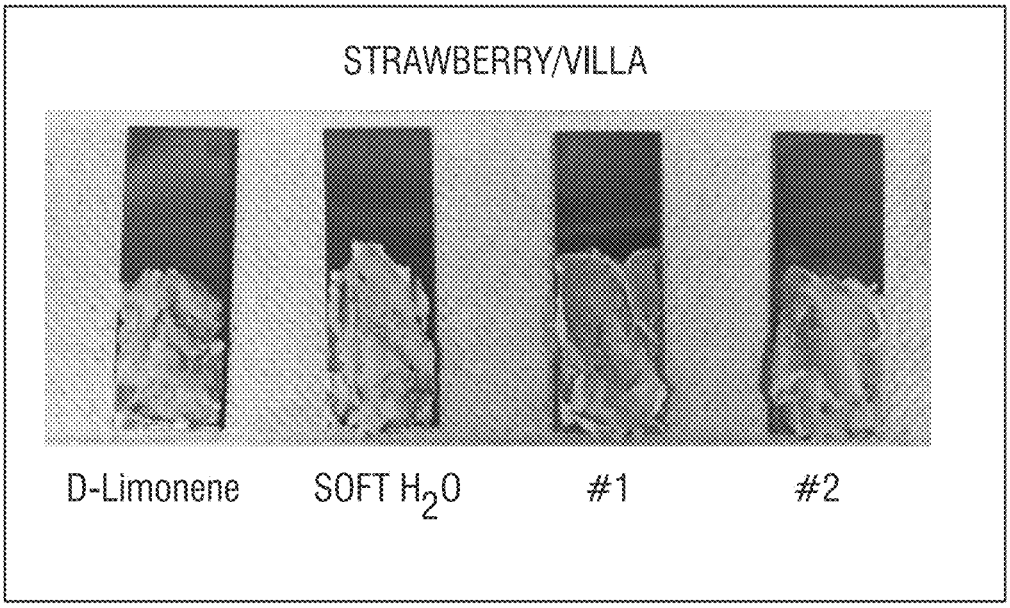
Figure 3C:
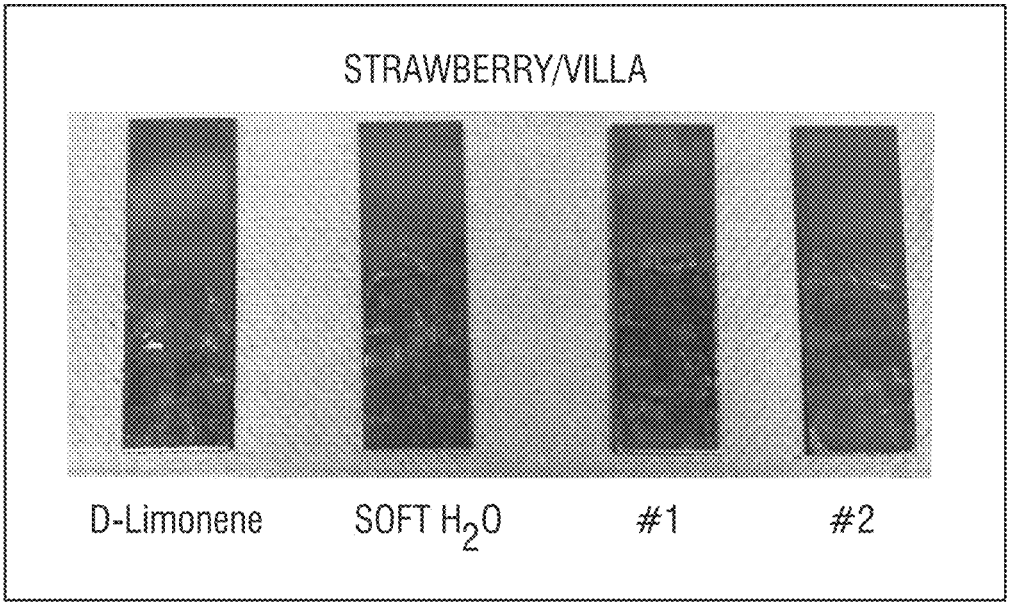
Figure 3D:
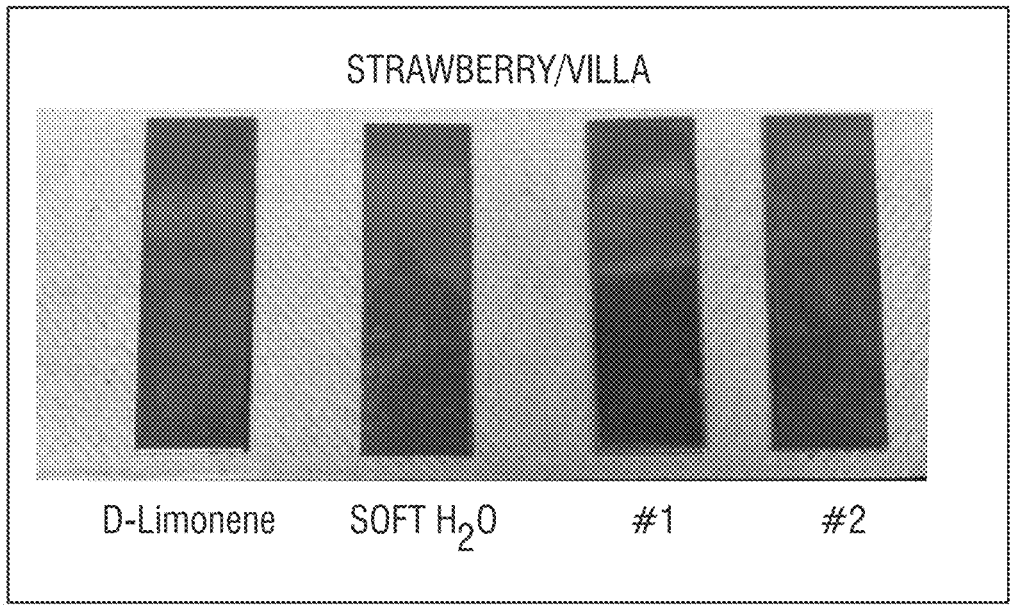

FIGS. 3A-D show gum removal experiments evaluating the Example 1 formulation on the strawberry/villa flavored gum. FIG. 3A shows the gum on the coupons before melting, FIG. 3B shows the coupons with gum before scraping, FIG. 3C shows the coupons after scraping and still containing gum residue, and FIG. 3D shows the coupons after spray of the experimental formula/controls and wiping. The evaluated formula shown as Example 1 demonstrated gum removal superior to controls.

Figure 4A:
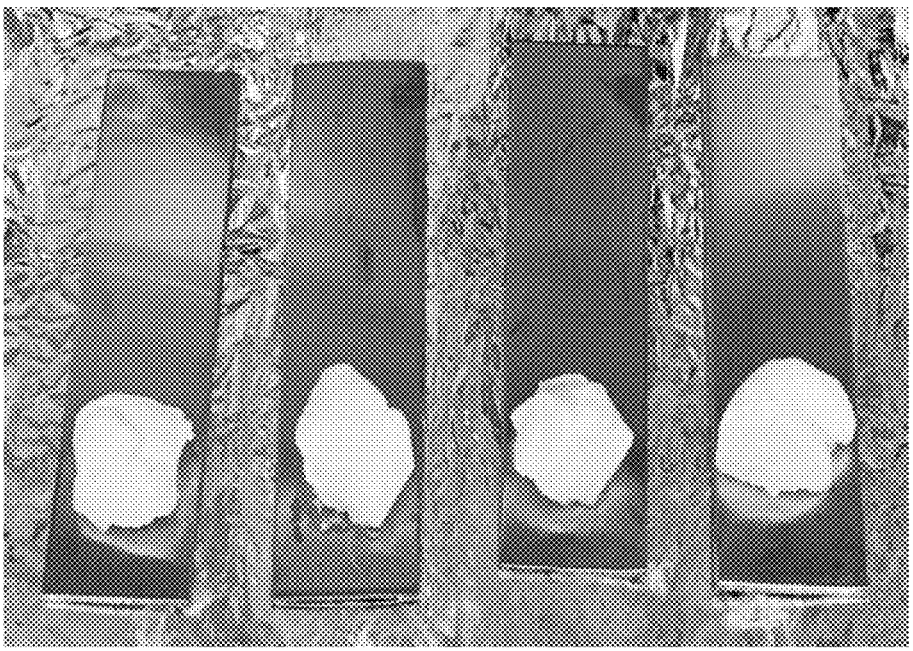
FIGS. 4A-D show phases of gum removal evaluation employing Example 1 formulation on the white-colored and grape flavored gum.
Figure 4B:
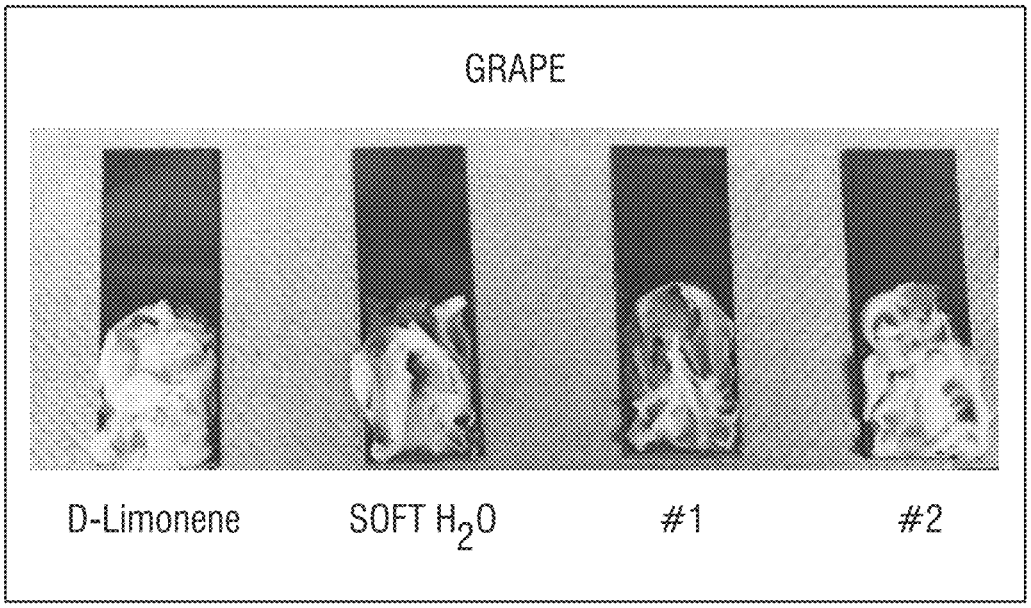
Figure 4C:
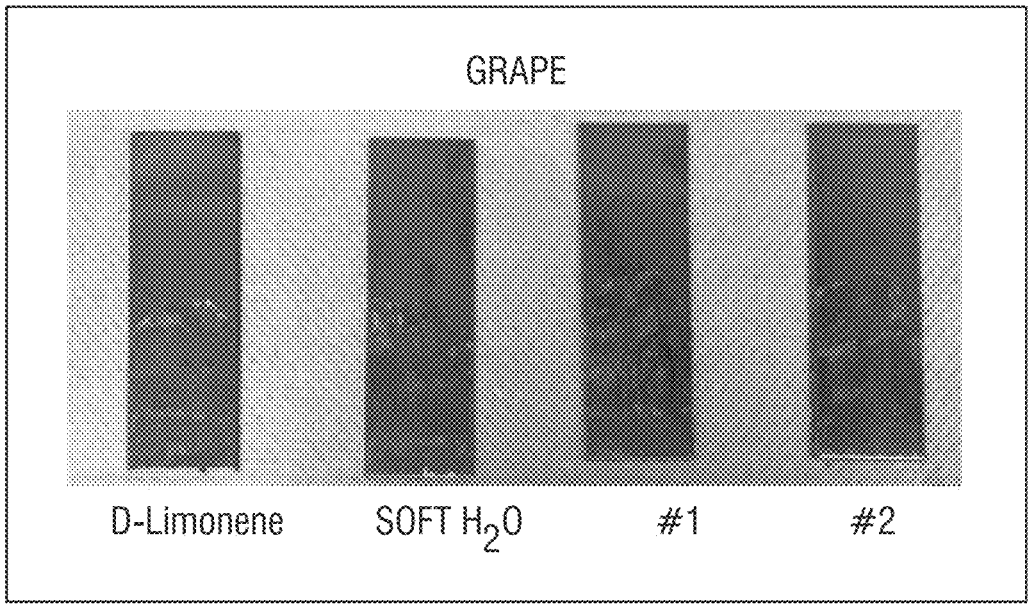
Figure 4D:
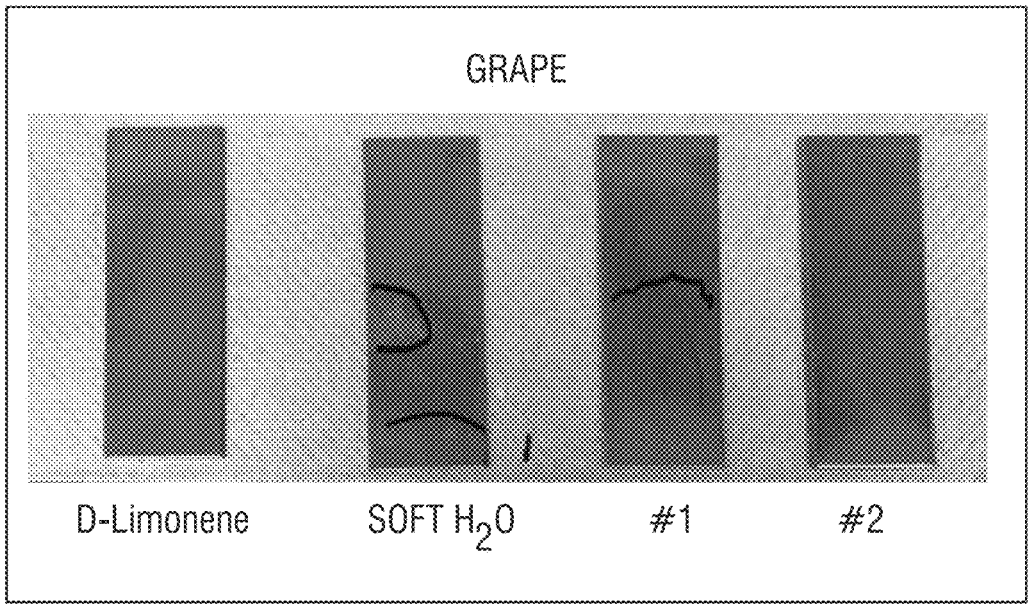

FIGS. 4A-D show gum removal experiments evaluating the Example 1 formulation on the white-colored grape flavored gum. FIG. 4A shows the gum on the coupons before melting, FIG. 4B shows the coupons with gum before scraping, FIG. 4C shows the coupons after scraping and still containing gum residue, and FIG. 4D shows the coupons after spray of the experimental formula/controls and wiping. The evaluated formula shown as Example 1 demonstrated gum removal superior to controls.

Figure 5A:
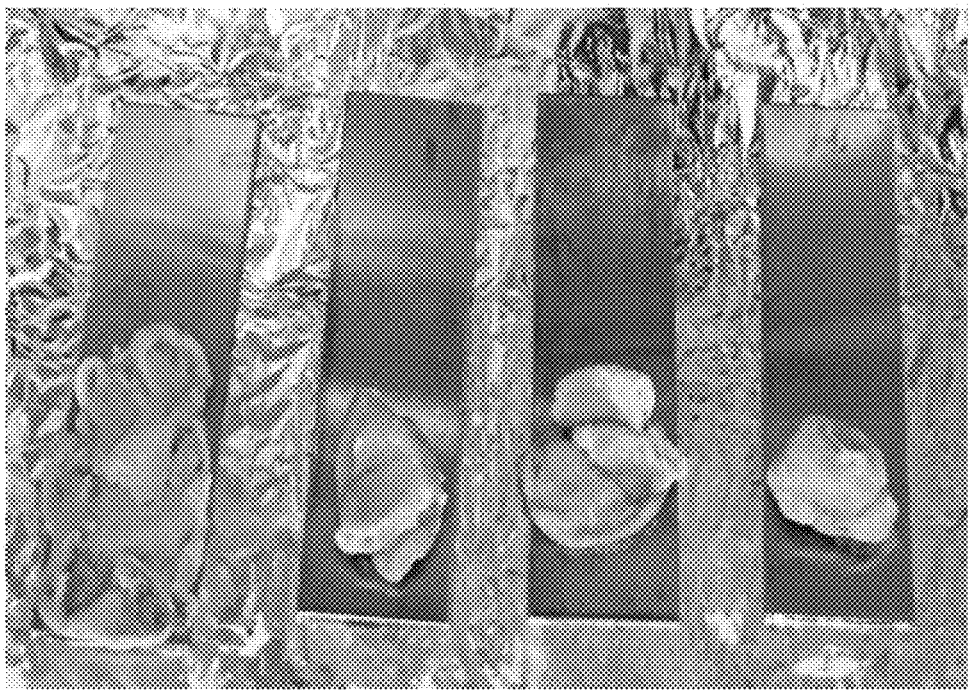
FIGS. 5A-D show phases of gum removal evaluation employing Example 1 formulation on a blackberry/mora flavored gum.
Figure 5B:
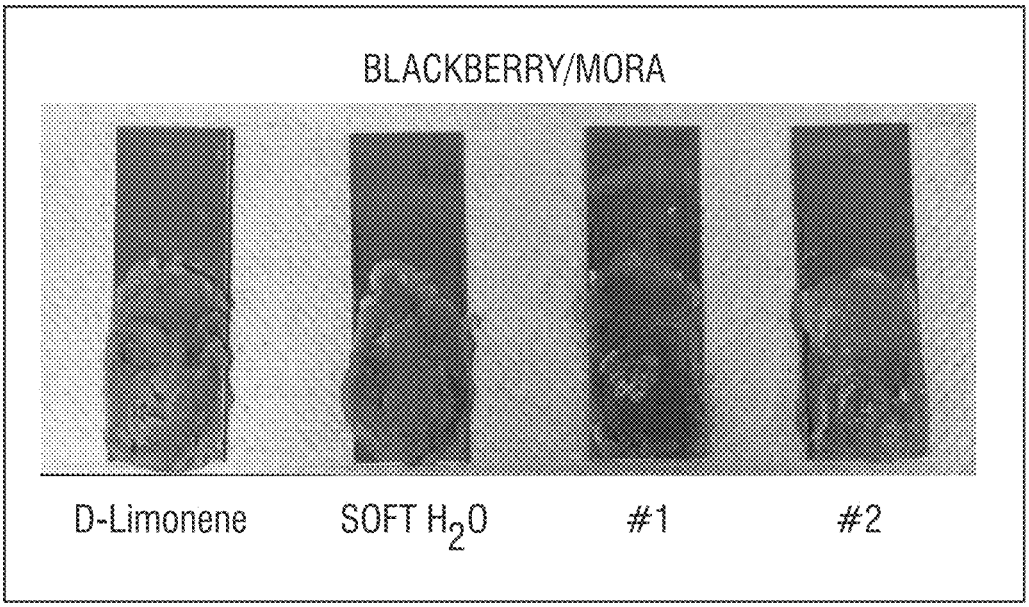
Figure 5C:
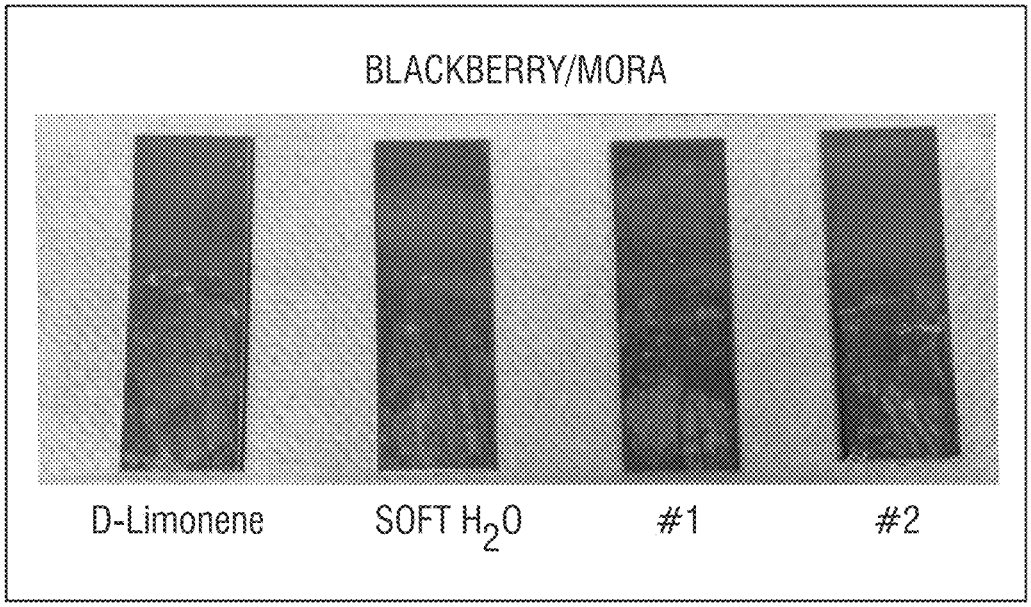
Figure 5D:
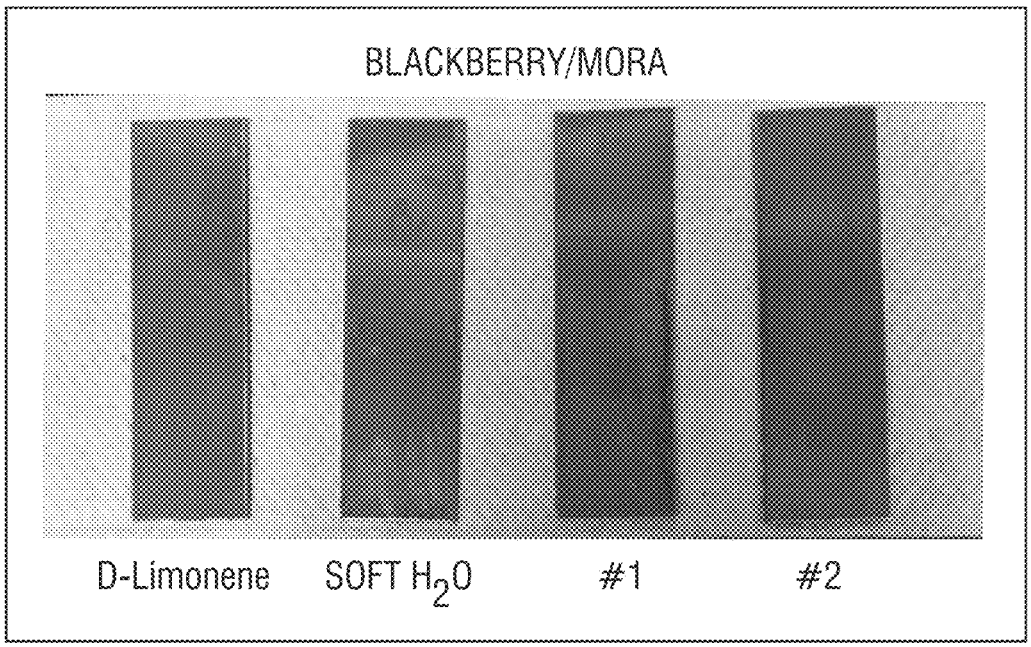

FIGS. 5A-D show additional gum removal experiments evaluating the Example 1 formulation on the blackberry/mora flavored gum. FIG. 5A shows the gum on the coupons before melting, FIG. 5B shows the coupons with gum before scraping, FIG. 5C shows the coupons after scraping and still containing gum residue, and FIG. 5D shows the coupons after spray of the experimental formula/controls and wiping. Again, the evaluated formula shown as Example 1 demonstrated gum removal superior to controls.

Figure 6A:
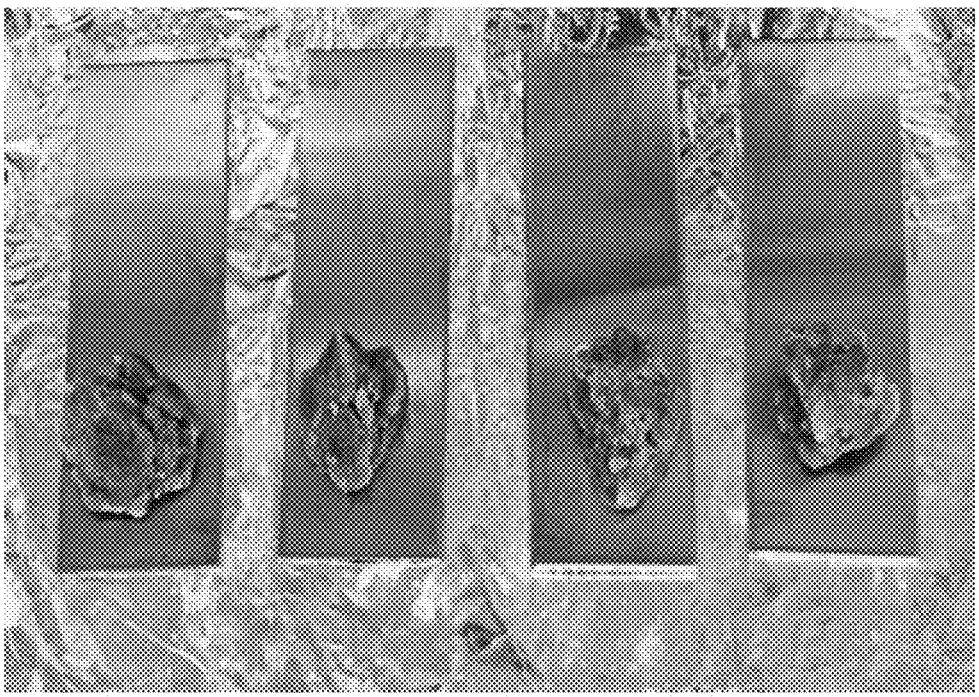
FIGS. 6A-D phases of gum removal evaluation employing Example 1 formulation on the zombie flavored gum.
Figure 6B:
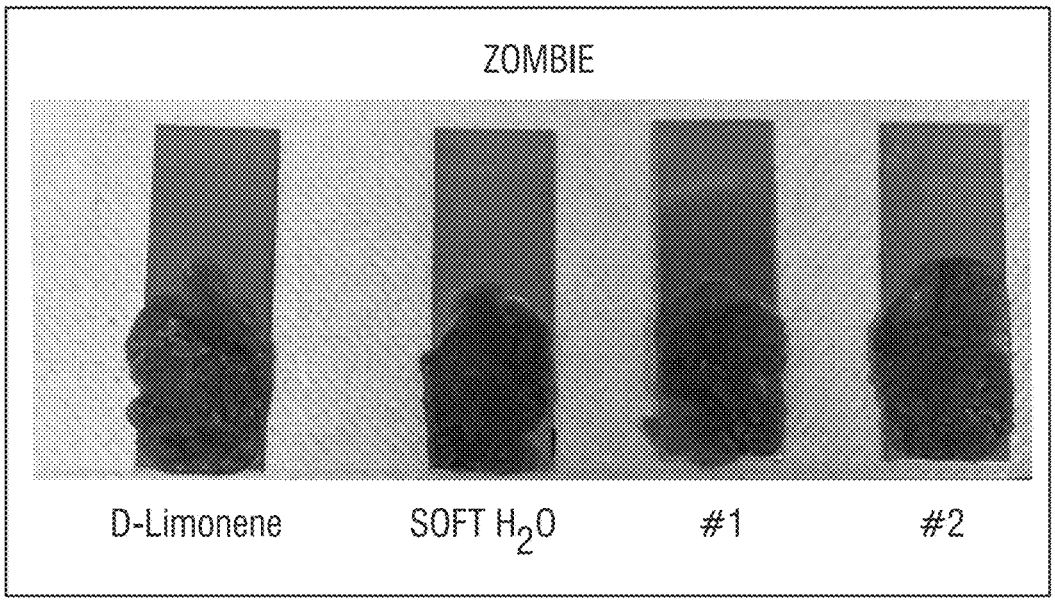
Figure 6C:
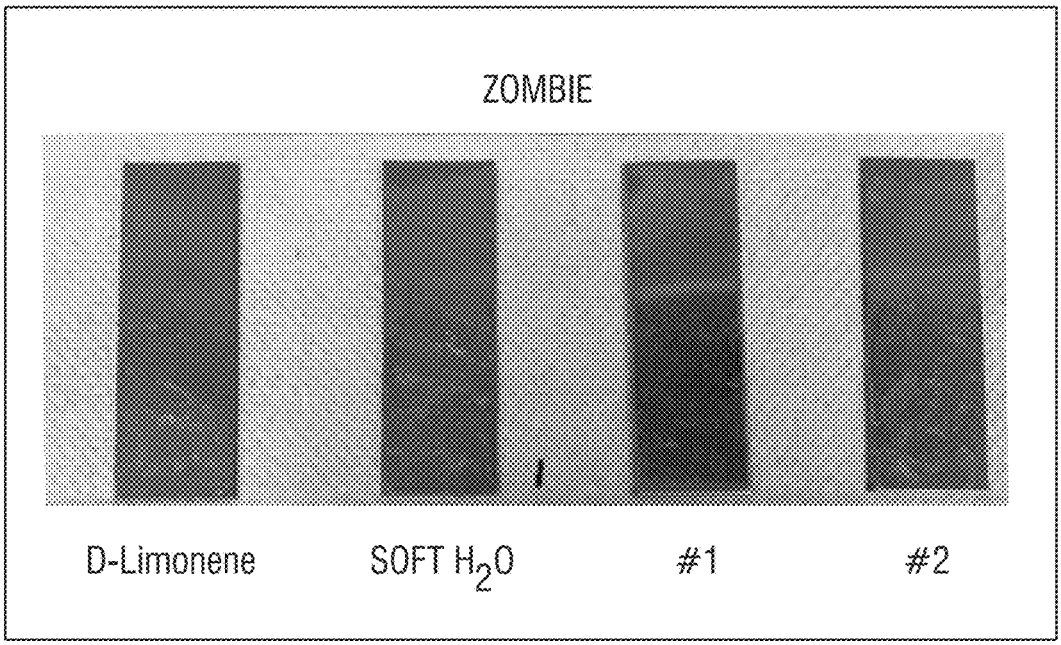
Figure 6D:
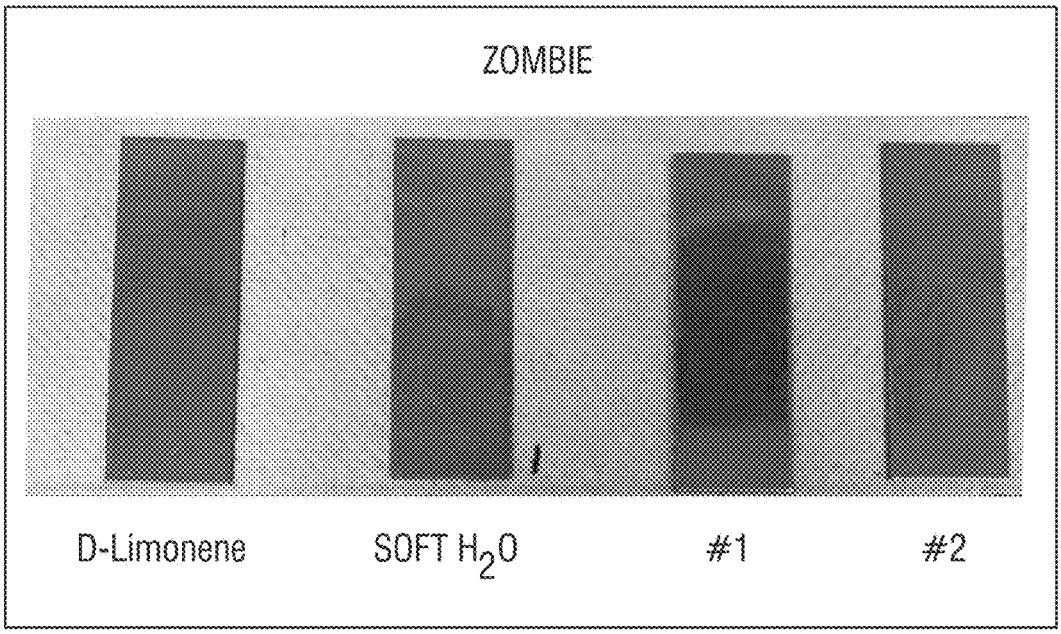

FIGS. 6A-D show additional gum removal experiment evaluating the Example 1 formulation on the zombie flavored gum. FIG. 6A shows the gum on the coupons before melting, FIG. 6B shows the coupons with gum before scraping, FIG. 6C shows the coupons after scraping and still containing gum residue, and FIG. 6D shows the coupons after spray of the experimental formula/controls and wiping. Again, the evaluated formula shown as Example 1 demonstrated gum removal superior to controls.

Example 2

Following the unexpected benefit of the no soak, no rinse gum removal obtained by the Example 1 formulation as shown in Example 1, additional modifications to the formulation were evaluated. The same static soak methods to remove gum set forth in Example 1 above were evaluated for Example 16 of Table 5.

TABLE 5

| | Example 11 | |
|---|---|---|
| Material | Wt., g | Wt. % |
| Water Zeolite Softened TNK | 1.03 | 10.25 |
| Glycerine, 96% | 4.92 | 48.96 |
| Propylene Glycol, USP | 1.55 | 15.42 |
| Ethyl Lactate | 2.55 | 25.37 |

Figure 7A:
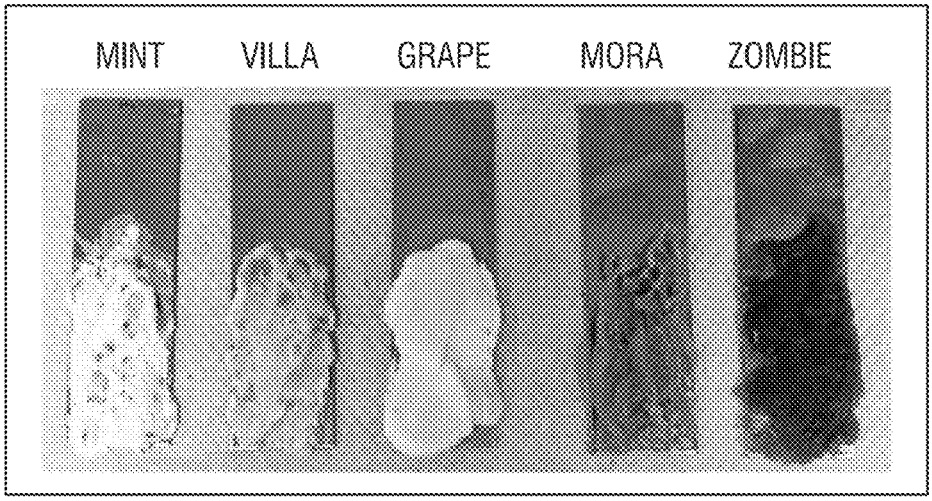
FIGS. 7A-C show further gum removal experiment evaluating the effect on formula performance with decreased water in the evaluated formulation according to additional embodiments of the disclosure.
Figure 7B:
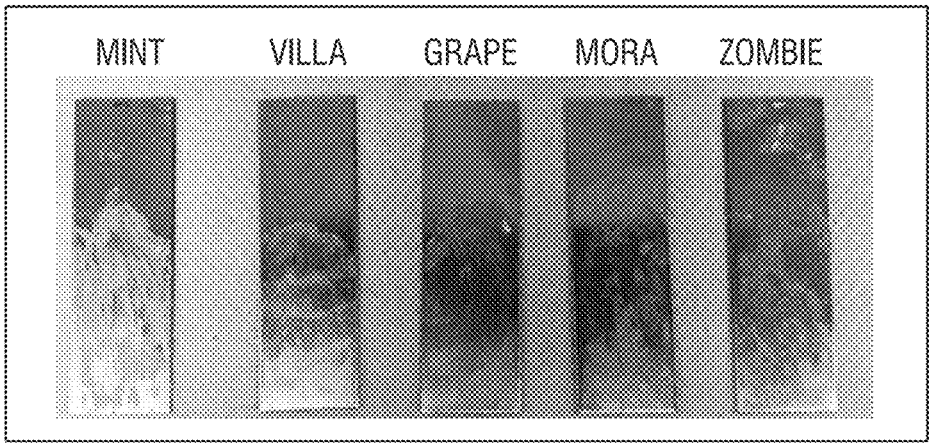
Figure 7C:
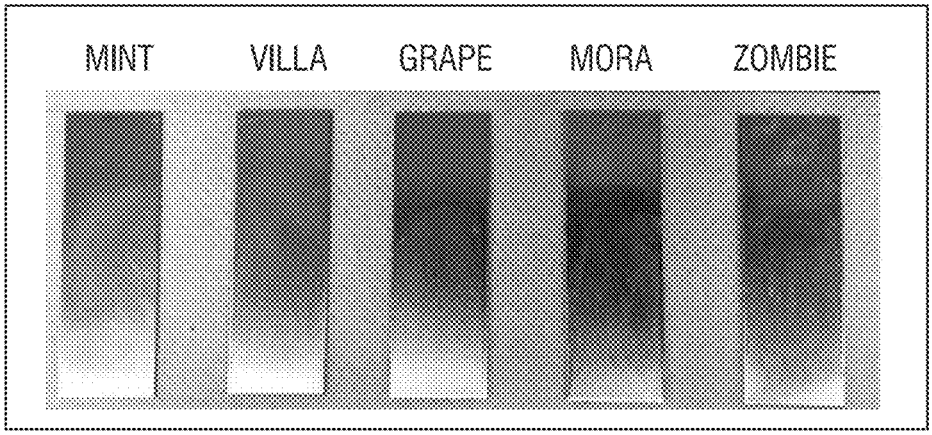

FIGS. 7A-C show the reduced water formulation gum removal experiments to evaluate the effect on formula performance when the quantity of water is decreased. The testing was conducted with a reduced-water formula of Example 11 on five flavored gums (mint, villa, grape, mora, and zombie). FIG. 7A shows the coupons with the five flavored gums before scraping. FIG. 7B shows the coupons after scraping and still containing gum residue. FIG. 7C shows the coupons with some residue remaining after spray of the experimental formula and wiping. The results in FIG. 7C show the removal of the gum compositions employing the cleaning composition solutions according to embodiments of the disclosure. In various applications it may be desirable to reduce the water content in the cleaning compositions.

Example 3

Additional evaluations were conducted for the no soak, no rinse gum removal cleaning compositions employing the methods of and formulation Example 1.

Figure 8A:
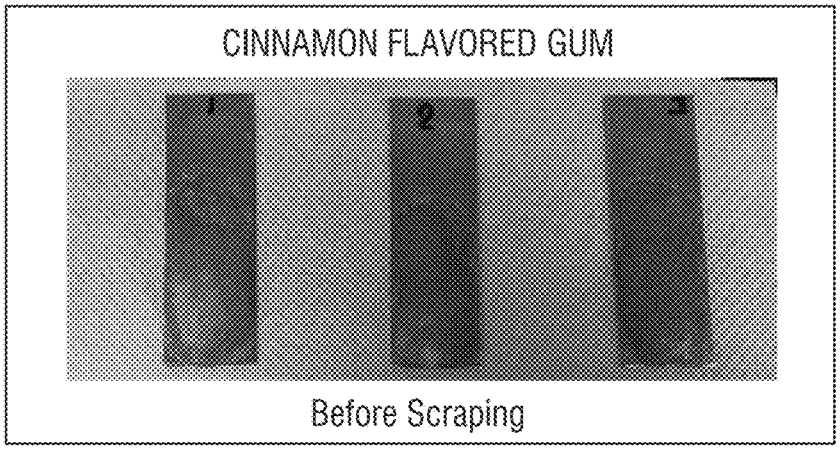
FIGS. 8A-C show additional gum removal evaluations employing Example 1 formulation on cinnamon flavored gum.
Figure 8B:
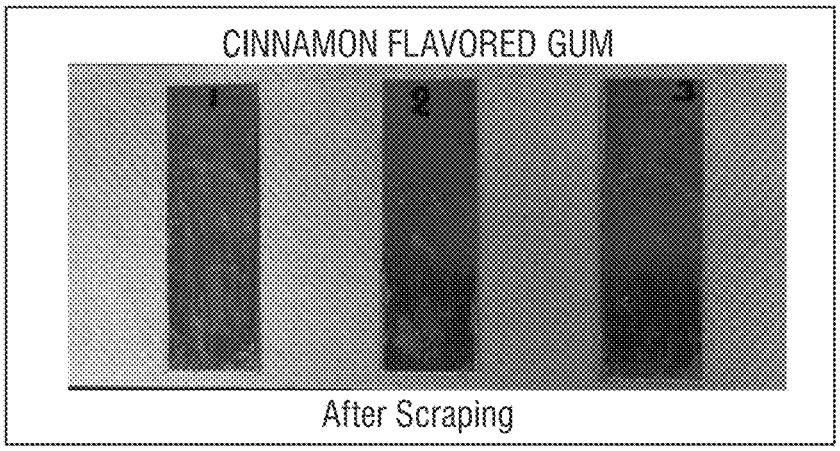
Figure 8C:
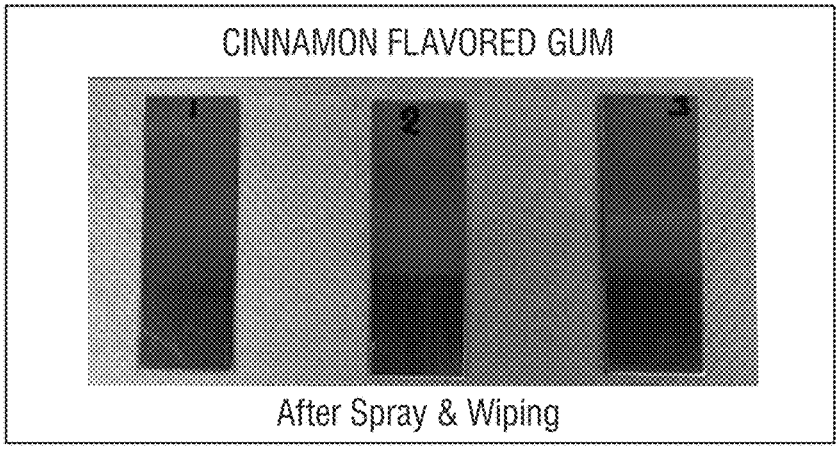

FIGS. 8A-C shows additional gum removal experiments evaluating the Example 1 formulation on the cinnamon flavored gum. FIG. 8A shows the gum on the coupons before scraping, FIG. 8B shows the coupons with gum after scraping, and FIG. 8C shows the coupons after spray of the experimental formula/controls and wiping. The evaluated formula shown as Example 1 demonstrated gum removal superior to controls.

Example 4

Figure 9A:
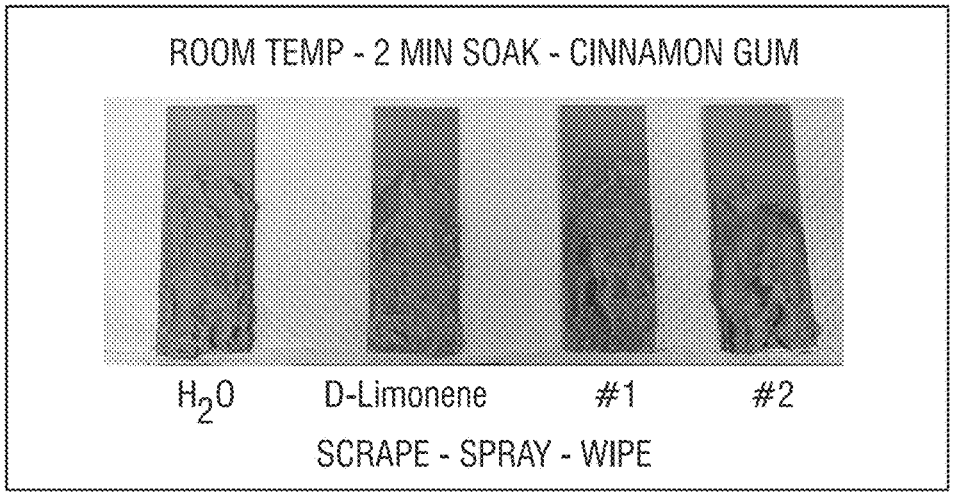
FIGS. 9A-C show additional gum removal experiment evaluating the effect of a two-minute soak of the Example 1 formulation on the cinnamon flavored gum.
Figure 9B:
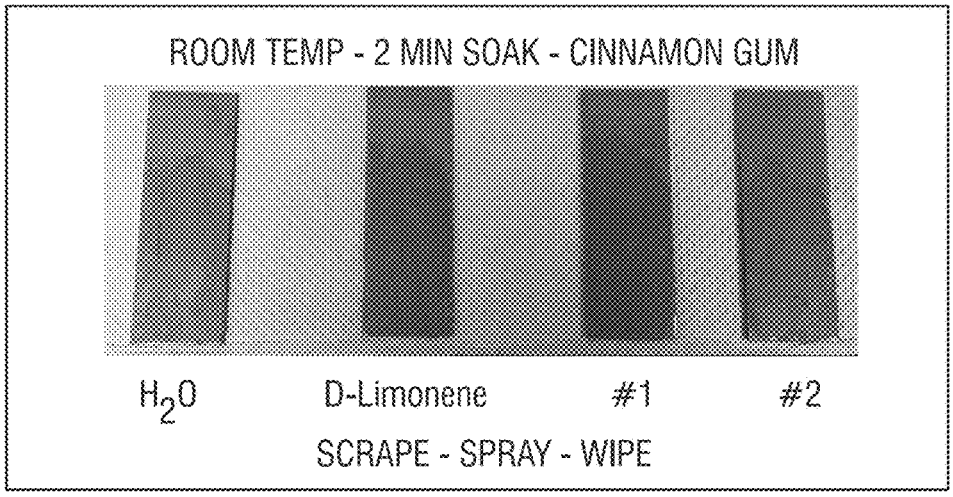
Figure 9C:
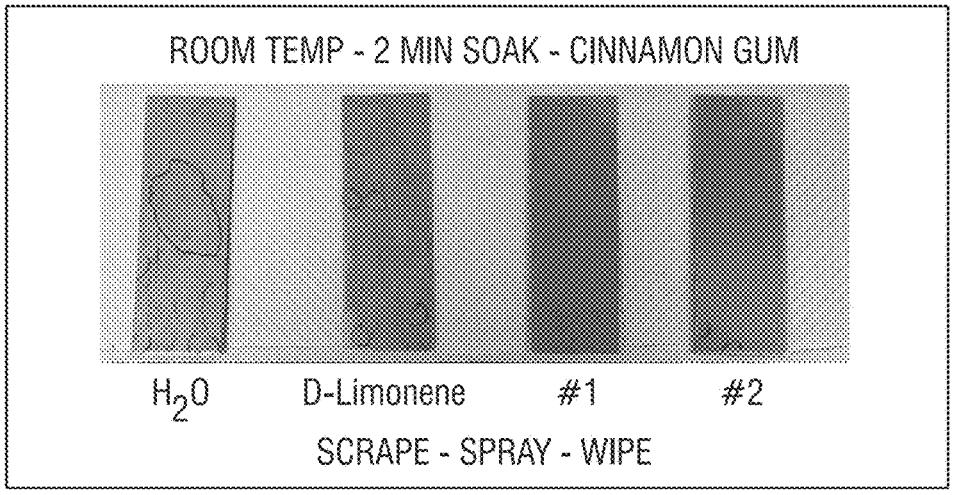

The lead formulation of Example 1 was further evaluated using a soak methodology. The soiled coupons were submerged into the formulation Example 1 for a two-minute soak of the coupons containing the cinnamon flavored of gum. FIG. 9A shows the gum on the coupons before scraping, FIG. 9B shows the coupons with gum after scraping, and FIG. 8C shows the coupons after wiping after the two-minute soak. The evaluated formula shown as Example 1 demonstrated gum removal superior to controls in a soak application as well as a scraping-spraying-wiping procedure.

Example 5

Industrial scale up use of the cleaning compositions according to the disclosure were conducted. The cleaning compositions were sprayed onto chewing gum residue on a hard surface and wiped off with a paper towel (or wipe) after a period of contact. For certain commercial applications the methods are optionally followed by a rinse or wipe step and/or a sanitization step to ensure sanitation from a regulatory perspective which is not a required step for removal of the soil according to embodiments of the disclosure.

Indicators of commercial applicability of the cleaning compositions is measured by the following criteria: (1) Equal or improved cleaning performance (visual evidence); (2) Reduced manual scraping providing for shorter cleaning times; (3) Minimum 30% reduction in cleaning time (based on residence time & ease of removal); and/or (4) Reduced manual scraping providing for fewer personnel during clean The disclosures being thus described, it will be obvious that the same may be varied in many ways. Such variations are not to be regarded as a departure from the spirit and scope of the disclosures and all such modifications are intended to be included within the scope of the following claims. The above specification provides a description of the manufacture and use of the disclosed compositions and methods. Since many embodiments can be made without departing from the spirit and scope of the disclosure, the invention resides in the claims.

What is claimed is:

1. A cleaning composition for application on a chewing gum residue or other sticky substance comprising:

a) about 1 wt-% to about 50 wt-% of a diluent;

b) about 5 wt-% to about 40 wt-% of a polyol;

c) about 10 wt-% to about 50 wt-% of an alkyl ester comprising ethyl lactate, ethylene acetate, polysorbate or a combination thereof; and d) a sodium acetate buffer, wherein:

i) the ratio of the polyol to alkyl ester is from about 10:1 to about 1:10;

ii) the composition is free of any material that is not considered to be a GRAS or food additive ingredient, and iii) the cleaning composition removes the chewing gum or other sticky substance from a surface.

2. The composition of claim 1, wherein a ratio of the polyol to alkyl ester is from about 6:1 to about 1:2.

3. The composition of claim 1, wherein the polyol is propylene glycol, glycerin, or a combination thereof.

4. The composition of claim 1, wherein the polysorbate comprises polysorbate 80, polysorbate 20, polysorbate 60, polysorbate 85, or a combination thereof.

5. The composition of claim 1, wherein the composition is free of d-limonene.

6. The composition of claim 1, wherein the diluent is selected from the group consisting of water, benzyl alcohol, methanol, ethanol, propanol, isopropanol, and mixtures thereof.

7. The composition of claim 1, further comprising at least one additional functional ingredient.

8. The composition of claim 7, wherein the additional functional ingredient is a dye, a fragrance, or a combination thereof.

9. The composition of claim 1, comprising about 1 wt-% to about 40 wt-% of diluent, about 5 wt-% to about 30 wt-% of the polyol, and about 10 wt-% to about 40 wt-% of the alkyl ester.

10. The composition of claim 1, comprising about 1 wt-% to about 50 wt-% of water as the diluent, about 5 wt-% to about 35 wt-% of propylene glycol as the polyol, and about 15 wt-% to about 30 wt-% of polysorbate 80 as the alkyl ester.

11. A method of removing chewing gum residue and/or other sticky food substances comprising:

optionally scraping a surface to remove excess chewing gum or other sticky food substance; and contacting the surface with a use solution of the cleaning composition or the cleaning composition of claim 1; and removing the chewing gum or other sticky food substance from the surface, wherein the surface has a soil left by chewing gum or other sticky food substances.

12. The method of claim 11, wherein the pH of the use solution or the cleaning composition is between about 3 and about 12.

13. The method of claim 11, wherein the use solution or the cleaning composition is at a temperature between about 70° F. and about 100° F.

14. The method of claim 11, wherein the contacting step is for a period of time to remove the soil, wherein the period of time is from 1 second to 30 minutes, from about 30 seconds to 5 minutes, from about 60 seconds to 10 minutes, or from about 2 minutes to 5 minutes.

15. The method of claim 11, wherein the method does not include a rinse step and the removing step is wiping the surface.

16. The method of claim 11, wherein the surface is a food processing or production surface or hard surface.

17. The method of claim 11, wherein the surface is one of stainless steel, plastics, polyethylene, polypropylene, aluminum, marble, granite, rubber, and concrete.

* * * * *